US009487034B2

(12) United States Patent
Ozaki

(10) Patent No.: US 9,487,034 B2
(45) Date of Patent: Nov. 8, 2016

(54) MEDIUM HOLDER, MEDIUM LOADING DEVICE, AND RECORDING APPARATUS

(71) Applicant: Seiko Epson Corporation, Tokyo (JP)

(72) Inventor: Kazuma Ozaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/926,754

(22) Filed: Oct. 29, 2015

(65) Prior Publication Data

US 2016/0122147 A1 May 5, 2016

(30) Foreign Application Priority Data

Nov. 5, 2014 (JP) ..... 2014-224971

(51) Int. Cl.
*B41J 11/58* (2006.01)
*B65H 19/12* (2006.01)

(52) U.S. Cl.
CPC ..... *B41J 11/58* (2013.01); *B65H 19/126* (2013.01); *B65H 2301/41346* (2013.01); *B65H 2301/41366* (2013.01); *B65H 2301/41369* (2013.01); *B65H 2511/12* (2013.01); *B65H 2801/36* (2013.01)

(58) Field of Classification Search
CPC ..... B65H 16/06; B65H 2301/41346; B65H 2301/4134; B65H 2301/4182; B65H 2301/41829; B65H 19/00; B65H 19/10; B41J 11/58; B41J 15/00; B41J 15/04
See application file for complete search history.

(56) References Cited

U.S. PATENT DOCUMENTS 3,743,198 A * 7/1973 Lucas ..... B65H 19/126 242/559.1
5,813,343 A * 9/1998 Harb ..... B65H 16/06 101/212
5,931,456 A * 8/1999 Laidlaw ..... B65H 1/04 271/171
6,241,407 B1 * 6/2001 Huggins ..... B41J 3/36 101/288
6,361,229 B1 * 3/2002 Shinga ..... B65H 75/08 160/323.1
6,431,492 B1 * 8/2002 Chillscyzn ..... B41J 15/042 242/577
8,790,028 B2 * 7/2014 Niihara ..... B41J 15/042 400/613
2003/0141655 A1 * 7/2003 Bryer ..... B65H 9/101 271/264
2003/0170065 A1 * 9/2003 Kim ..... B41J 3/4075 400/718
2008/0011805 A1 * 1/2008 Genta ..... B65H 19/126 226/51
2008/0277851 A1 11/2008 Genta
2009/0269119 A1 * 10/2009 Hatada ..... B41J 11/001 400/618
2013/0271543 A1 10/2013 Akatsu et al.
2014/0205356 A1 * 7/2014 Mistyurik ..... B41J 3/4075 400/613
2015/0225198 A1 * 8/2015 Sakaino ..... B41J 11/0025 242/566

FOREIGN PATENT DOCUMENTS

JP 7-42700 U 8/1995
JP 2003-341886 A 12/2003
JP 2007-261754 A 10/2007
JP 2010-110965 A 5/2010
JP 2011-110708 A 6/2011
JP 2013-220567 A 10/2013
JP 2015150754 A * 2/2014 ..... B65H 23/04

* cited by examiner

OTHER PUBLICATIONS

Sakaino, Machine Translation of JP 2014-025468 (Publication # JP 2015-150754A), 2014.*

*Primary Examiner* — Geoffrey Mruk
*Assistant Examiner* — Scott A Richmond

(57) ABSTRACT

A medium holder is provided with a movement restriction section that restricts movement in a direction that is opposite to a side that holds the rolled medium during installation of a medium loading device in a medium loading section.

4 Claims, 18 Drawing Sheets

MEDIUM HOLDER, MEDIUM LOADING DEVICE, AND RECORDING APPARATUS

BACKGROUND

1. Technical Field

The present invention relates to a medium holder, a medium loading device, and a recording apparatus.

2. Related Art

In the related art, medium loading devices that are provided with support units, which respectively support both end sections of a rolled medium, and loading sections into which the support units are loaded, are known. In the medium loading devices, first sides of the support units are fixed by guides that are provided in the loading section when the support units, which are disposed at both end sections of a rolled medium are loaded into the loading section (refer to JP-A-2013-220567).

However, in the abovementioned devices, the first sides of the support units are fixed by the guides in the loading section, but since the second sides of the support units are not fixed, there is a problem in that it is easy for the second sides of the support units to move in a direction that is opposite to a side on which the second sides of the support unit hold the rolled medium and which applies a rotational force in accordance with a rotational action due to the transport of the rolled medium, and therefore, the support units come loose from the rolled medium.

SUMMARY

The invention can be realized in the following aspects or application examples.

Application Example 1

According to this application example, there is provided a medium holder including a movement restriction section that restricts movement of a rolled medium in a roll width direction of the rolled medium during installation in a medium loading section of a medium loading device.

According to this configuration, the medium holder restricts movement of the rolled medium in a roll width direction. As a result of this, it is possible to make it difficult for the medium holder to come loose from the rolled medium.

Application Example 2

In the medium holder according to the application example, it is preferable that the medium holder can be attached on both of either first sides or second sides of both end sections of the rolled medium.

According to this configuration, it is possible to select an attachment direction of the medium holder depending on a configuration of the medium loading section of the medium loading device, and therefore, it is possible to make the medium holder easier to handle.

Application Example 3

According to this application example, there is provided a medium loading device including a medium loading section, and a restriction member that engages with a movement restriction section, which a medium holder is provided with, when the medium holder is mounted in the medium loading section.

According to this configuration, the restriction member, which engages with the movement restriction section of the medium holder, is provided in the medium loading device, and movement of the medium holder with respect to the medium loading device is restricted. As a result of this, it is possible to make it difficult for the medium holder, which holds the rolled medium, to come loose from the rolled medium.

Application Example 4

In the medium loading device according to the application example, it is preferable that the restriction member configures a ratchet mechanism, and the movement restriction section of the medium holder is a hook section that engages with the ratchet mechanism.

According to this configuration, it is possible to restrict movement of the medium holder with respect to the medium loading device with a simple configuration.

Application Example 5

In the medium loading device according to the application example, it is preferable that the medium holder includes a concave section, and the hook section is disposed inside the concave section.

According to this configuration, since, for example, the hook section is even disposed inside the concave section in a case in which the medium holder has fallen, it is difficult for the hook section to come into direct contact with a fallen surface, and therefore, it is possible to prevent damage or the like of the hook section.

Application Example 6

In the medium loading device according to the application example, it is preferable that the restriction member is provided in a plurality of locations.

According to this configuration, it is possible to restrict the movement of the medium holder at a plurality of locations.

Application Example 7

According to this application example, there is provided a recording apparatus including a medium loading section that includes a restriction member, which engages with a movement restriction section that a medium holder is provided with, when the medium holder is mounted, a transport section that transports a rolled medium that is loaded in the medium loading section, and a recording section that performs recording on the rolled medium that is transported.

According to this configuration, the restriction member of the medium loading section and the movement restriction section of the medium holder engage with one another, and movement of the medium holder with respect to the medium loading section is restricted. As a result of this, it is possible to transport a rolled medium in a state in which it is difficult for the medium holder, which holds the rolled medium, to come loose from the rolled medium. As a result of this, the occurrence of bending and creasing of the rolled medium during transport is suppressed, and therefore, it is possible to prevent the occurrence of printing defects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. Additionally, in order to have a size of an extent that is recognizable in each of the following figures, the scale of each member, and the like, is shown in a manner that differs from a practical scale.

Firstly, a configuration of a recording apparatus will be described. The recording apparatus is provided with a medium loading section that includes a restriction member, which engages with a movement restriction section that a medium holder is provided with, when the medium holder is mounted, a transport section that transports a rolled medium that is loaded in the medium loading section, and a recording section that performs recording on the rolled medium that is transported. The recording apparatus is, for example, an ink jet type printer. In the present embodiment, a large format printer (LFP), which handles comparatively large media (rolled media), will be described as a configuration example of the recording apparatus.

Figure 1:
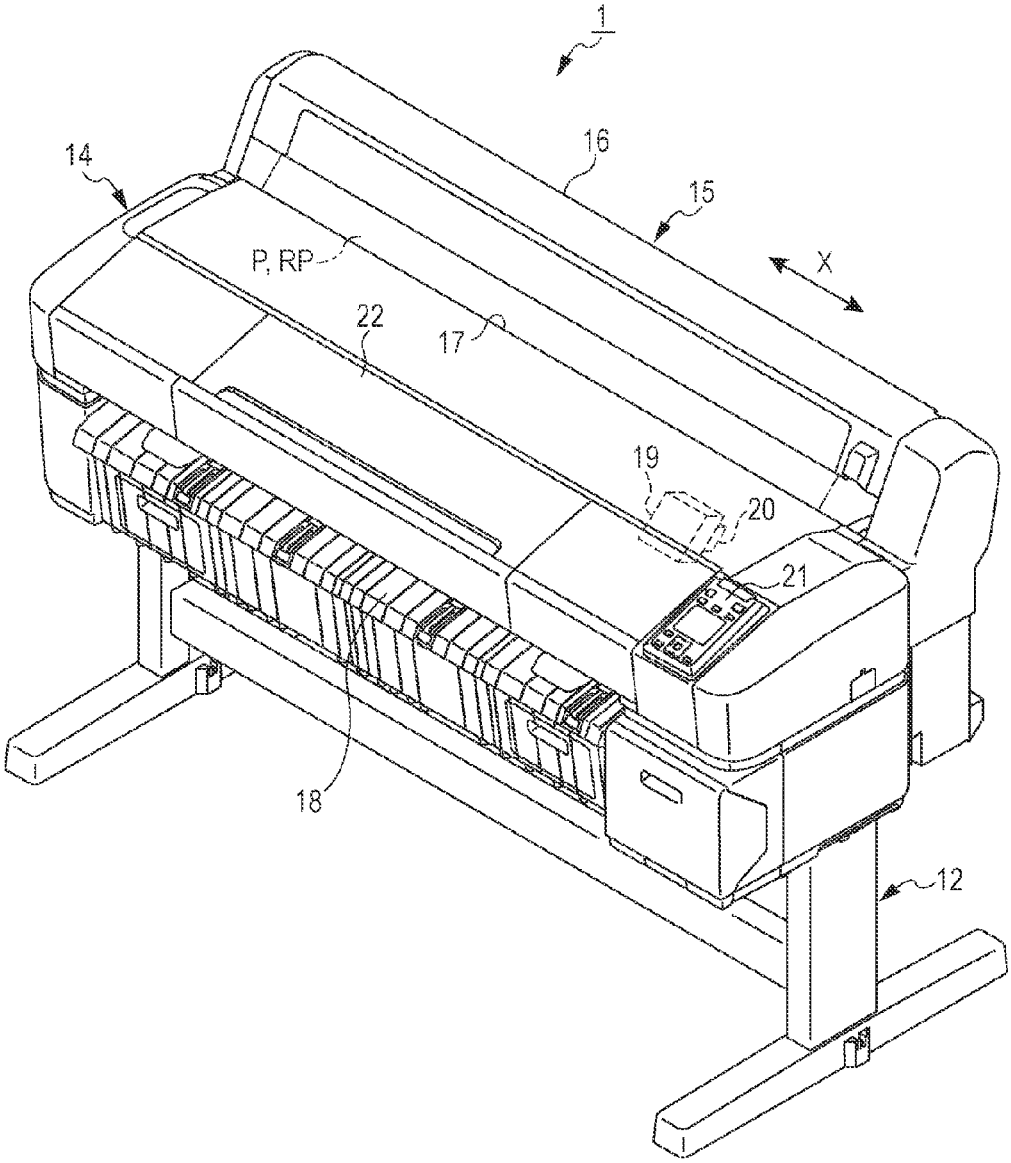
FIG. 1 is an outline view that shows a configuration of a recording apparatus.

FIG. 1 is an outline view that shows a configuration of a recording apparatus. As shown in FIG. 1, a recording apparatus 1 is supported by a leg platform 12. The recording apparatus 1 is provided with a main body 14 that has a substantially rectangular parallelepiped shape, a paper supply section 15, which is provided so as to protrude out from a rear surface section of the main body 14 in an oblique manner toward an upper back side, and includes a medium loading section (a medium loading device) that is loaded with rolled paper RP, as a rolled medium that is formed by sheets of paper P, as a longitudinal medium, being wound up in a rolled shape, and the like.

A flip-up type opening and closing cover 16 is provided on an upper end section of the paper supply section 15. In addition, a paper supply opening 17 for feeding sheets of paper P, which are sent out while unwinding from rolled paper RP that is loaded in the paper supply section 15, into the main body 14, is formed at a boundary position with the main body 14 in a lower end section of the paper supply section 15. A transport section, which is not illustrated, and which transports sheets of paper P that are fed along a transport pathway thereof from the paper supply opening 17 to a discharge opening 18, which is formed in a front surface section of the main body 14, is provided inside the main body 14.

A carriage 19 is provided so as to be capable of reciprocating in a width direction, which intersects a transport direction of the sheets of paper P, inside the main body 14 in a position that faces the transport pathway of the sheets of paper P. A recording head 20, as a recording section that performs printing, as a recording process, by ejecting an ink from nozzles (not illustrated) onto sheets of paper P that are transported in the transport pathway while reciprocating with the carriage 19 in a scanning direction X (a longitudinal direction of the main body 14; a roll width direction of the rolled paper RP; and an X axis direction), which intersects the transport direction of the sheets of paper P, is supported in the carriage 19 in a position that faces the transport pathway of the sheets of paper P. In addition, an operation panel 21 for a user to perform various setting operations, input operations of various information and the like, is, for example, provided in a right end upper section of the main body 14. A maintenance cover 22 for performing maintenance inside the main body 14, is provided in an upper section of the main body 14 in a freely openable and closeable manner.

Figure 2:
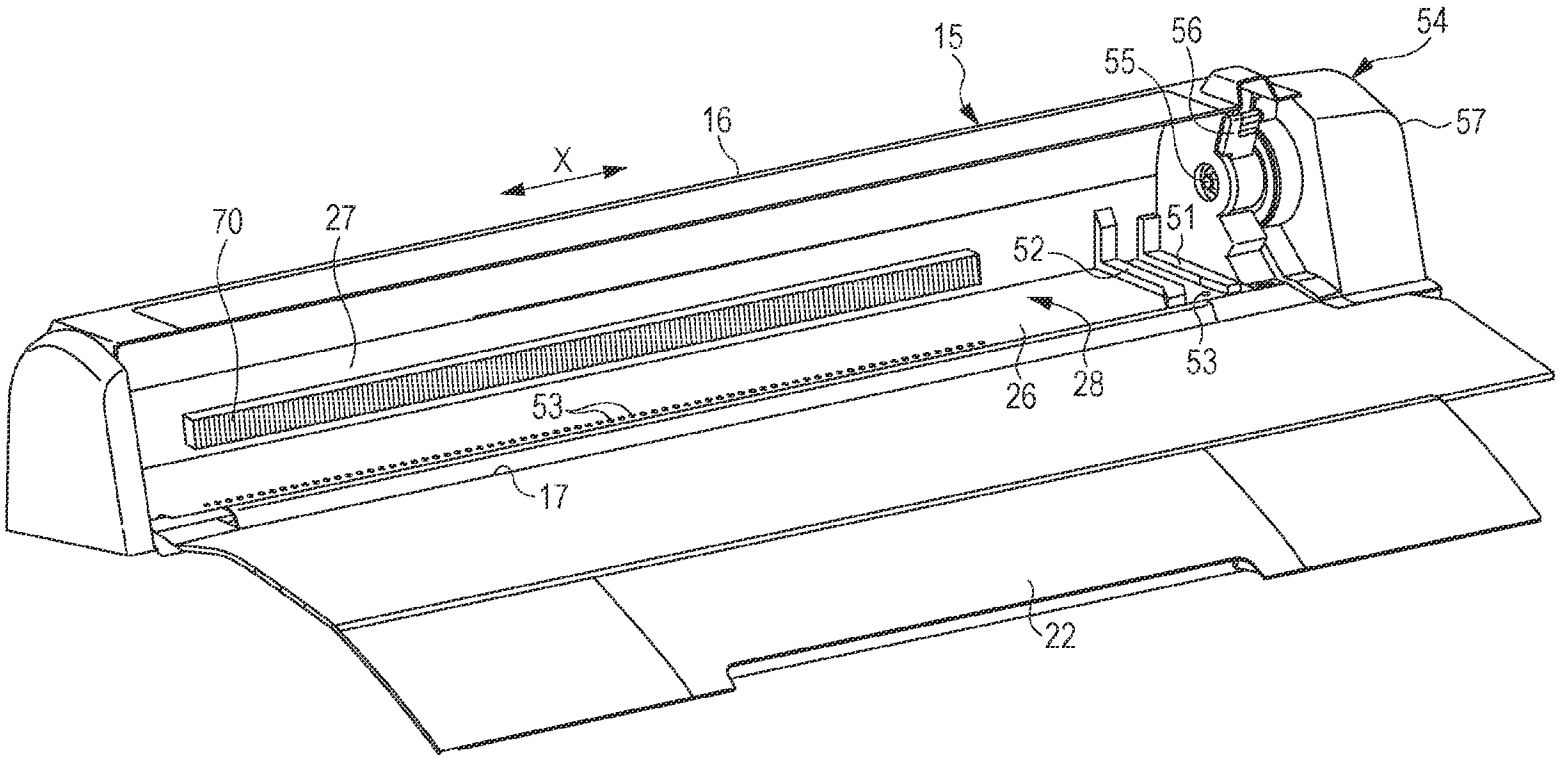
FIG. 2 is an outline view that shows a configuration of a paper supply section.

Next, a configuration of the paper supply section will be described. FIG. 2 is an outline view that shows a configuration of a paper supply section. The paper supply section 15 loads rolled paper RP, and includes a medium loading section (a medium loading device).

A bottom plate 26 is provided in a lower end section of the paper supply section 15. A rectangular back side plate 27 is vertically arranged in the bottom plate 26 in an end section of a side that is opposite to a paper supply opening 17 side so as to intersect an extension direction of the bottom plate 26. Further, a region on the bottom plate 26 is a medium loading section 28 into which rolled paper RP is loaded. The bottom plate 26 is inclined so that a back side thereof is lower, and therefore, it is easy to load rolled paper RP into the medium loading section 28. In addition, a rotational force application unit 54 that applies a rotational force to rolled paper RP that is loaded in the paper supply section 15, and the like, is provided on a first end side in the X axis direction of the paper supply section 15.

A restriction member 70 is disposed in the medium loading section 28. The restriction member 70 engages with a movement restriction section that a medium holder 30 (refer to FIG. 4) is provided with, when the medium holder 30 is mounted in the medium loading section 28. The restriction member 70 according to the present embodiment is disposed on a back side plate 27 surface.

Figure 3A:
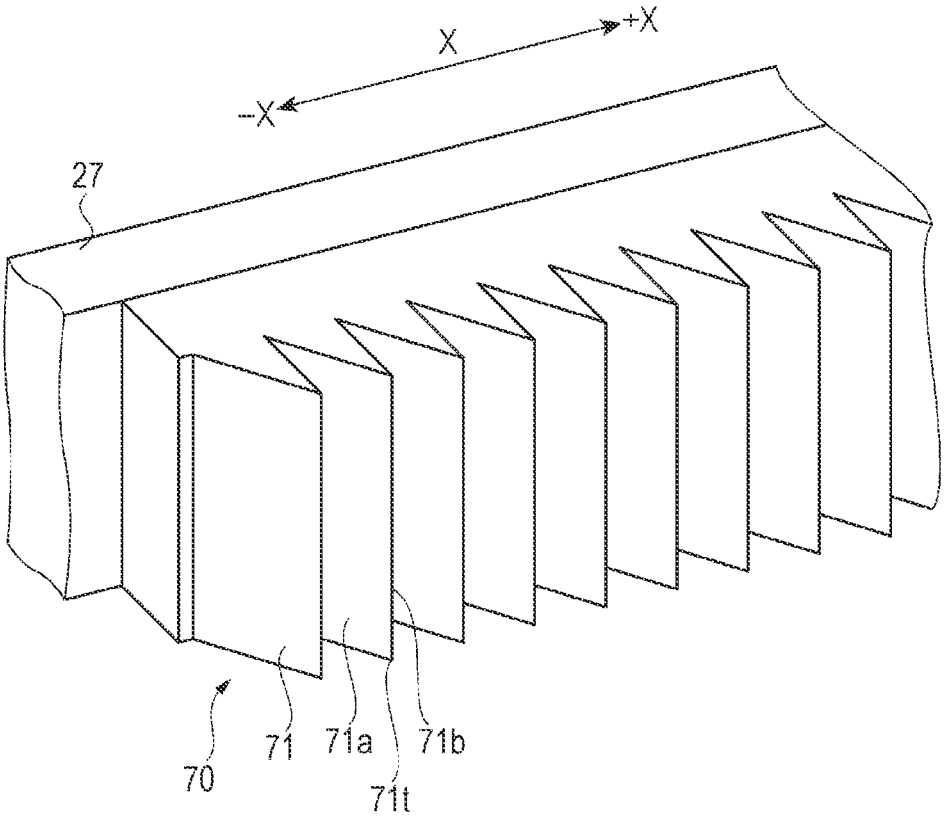
FIGS. 3A and 3B are enlarged views that show a configuration of a restriction member.
Figure 3B:
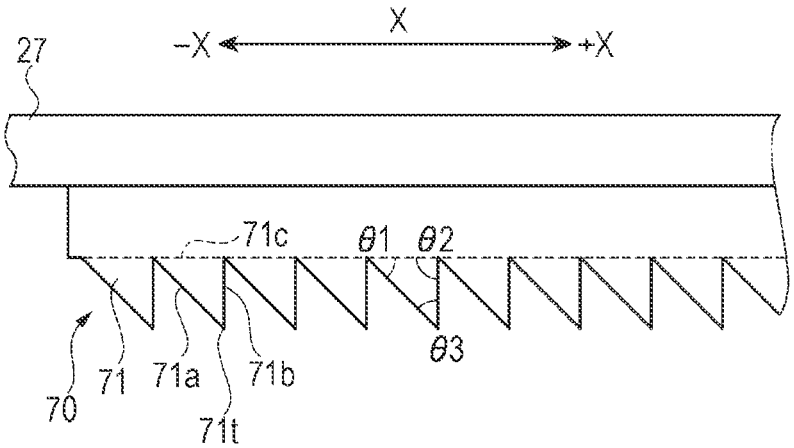

FIGS. 3A and 3B are enlarged views that show a configuration of the restriction member 70, FIG. 3A is a perspective view, and FIG. 3B is a plan view. As shown in FIGS. 3A and 3B, the restriction member 70 according to the present embodiment configures a ratchet mechanism. More specifically, the restriction member 70 includes a plurality of acute sections 71, the leading ends of which are pointed, and the acute sections 71 are arranged in parallel in a serrated manner along the X axis direction. In addition, the acute sections 71 are arranged so as to be inclined in one direction. As a ratchet mechanism, the restriction member 70 is for engaging with a hook section of a medium holder, which will be described later, and restricting movement of the medium holder. As shown in FIGS. 3A and 3B, the acute sections 71 of the present embodiment are configured by a first surface 71*a* and a second surface 71*b* that are in contact with a tip section 71*t*. Further, as shown in FIG. 3B, the acute sections 71 are configured so that, when the acute sections 71 are viewed in plan view as triangles that are configured by virtual bottom sides (surfaces) 71*c*, which face the tip sections 71*t* of the acute sections 71, the first surfaces 71*a* and the second surfaces 71*b*, a first angle θ1 that is defined by the virtual bottom surface 71*c* and the first surface 71*a* is an acute angle, a second angle θ2 that is defined by the virtual bottom surface 71*c* and the second surface 71*b* is set to be greater than or equal to 90°, and a third angle θ3 that is defined by the first surface 71*a* and the second surfaces 71*b* is an acute angle. As a result of this, the acute sections 71 are arranged so as to be inclined in one direction.

Figure 4A:
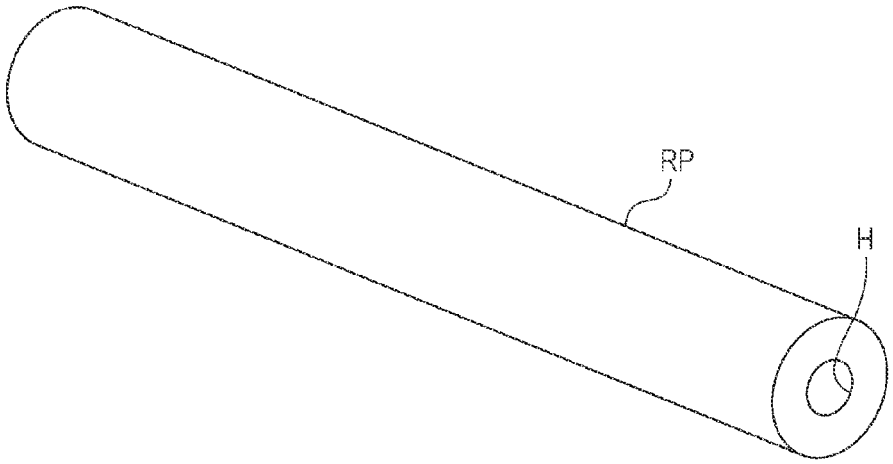
FIGS. 4A and 4B are outline views that show a configuration of a medium holder.
Figure 4B:
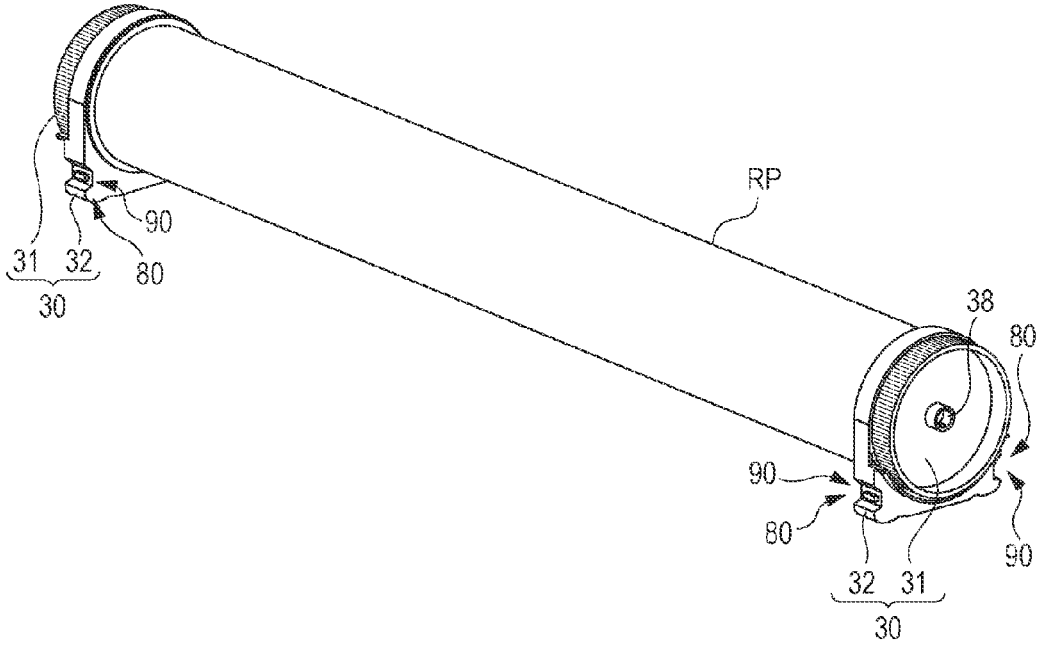

Next, a configuration of a medium holder will be described. FIGS. 4A to 6 are outline views that show a configuration of a medium holder. In addition, FIG. 7 is an outline view (a plan view) that shows a configuration of a movement restriction section. FIG. 4A shows an external appearance of rolled paper, and FIG. 4B shows a state in which medium holders have been attached to the rolled paper. As shown in FIG. 4B, in a case in which rolled paper RP is loaded in the medium loading section 28, the medium holders 30, which hold (support) the rolled paper RP in a rotatable manner, are attached to both end sections of the rolled paper RP. Additionally, the configurations of the respective medium holders 30 that are attached to both end sections of the rolled paper RP are the same. The medium holder 30 is provided with a shaft member 31 that integrally holds rolled paper RP in a rotatable manner, and a flange member 32 that supports the shaft member 31 in a rotatable manner. Furthermore, the medium holder 30 is provided with a movement restriction section 80 that restricts movement in a direction that is opposite to a side on which the medium holder 30 holds rolled paper RP during installation in the medium loading section 28.

Figure 5:
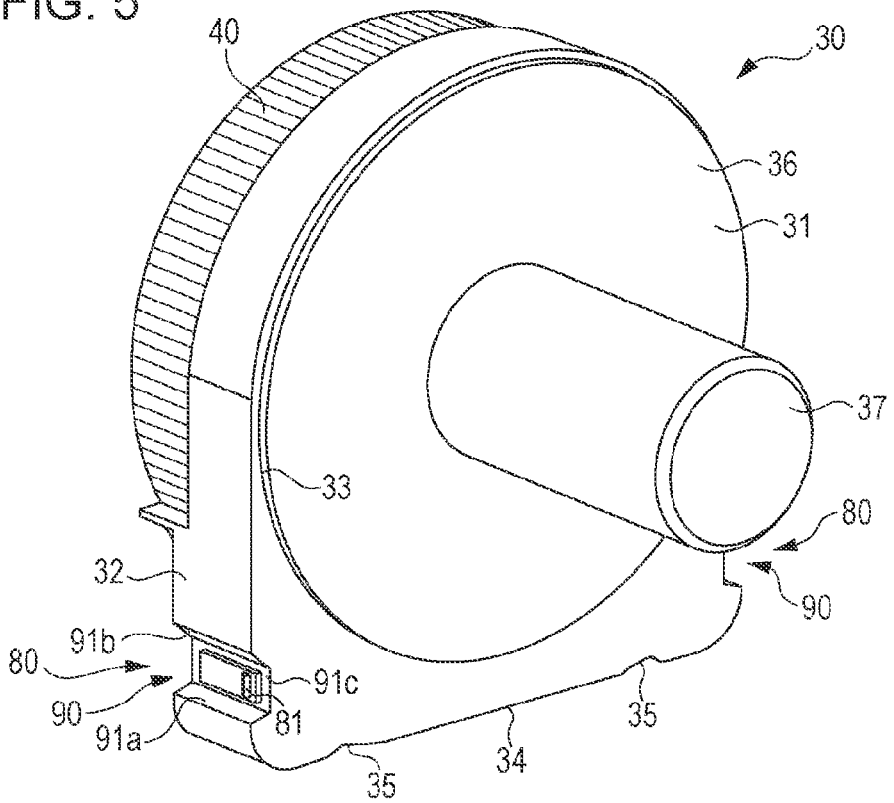
FIG. 5 is a perspective view that shows a configuration of the medium holder.
Figure 6:
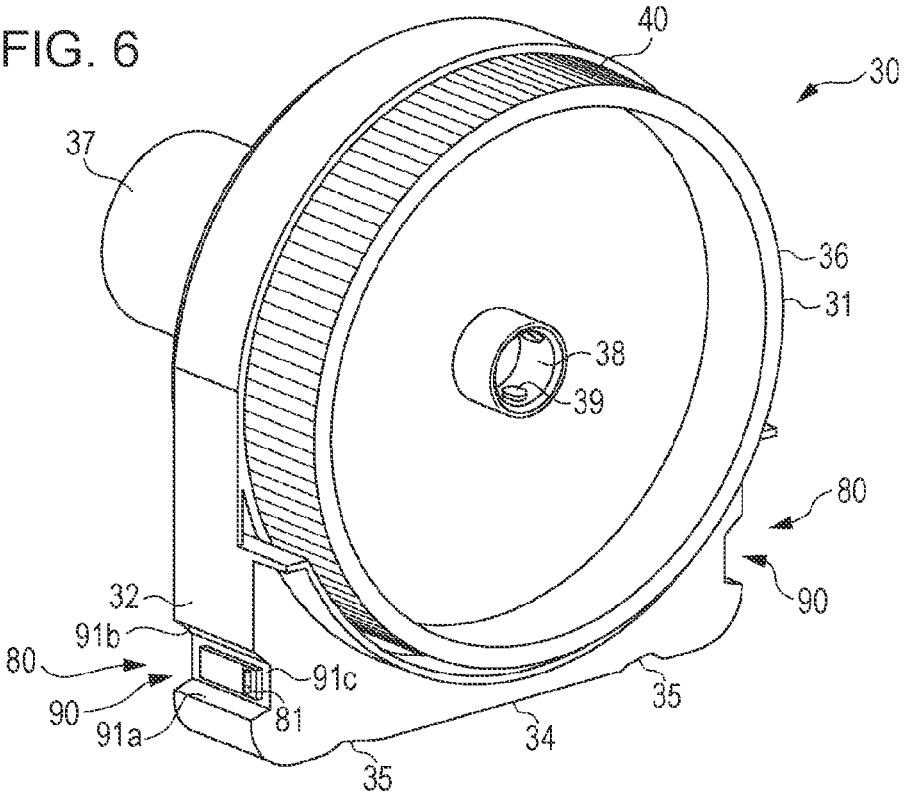
FIG. 6 is a perspective view that shows a configuration of the medium holder.
Figure 7:
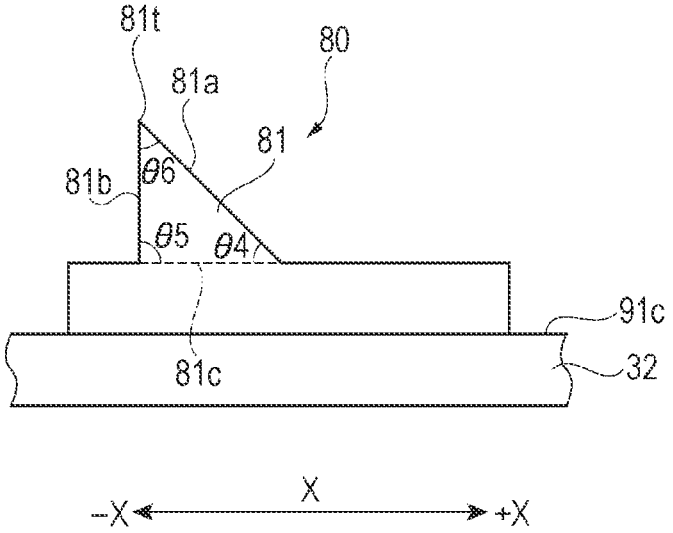
FIG. 7 is an outline view that shows a configuration of a movement restriction section.

As shown in FIGS. 5 and 6, an upper side half of the flange member 32 of the medium holder 30 has a semicircular shape, and a lower side half thereof has a substantially rectangular shape. That is, the flange member 32 forms a substantial D shape overall. A circular support hole 33 is formed so as to penetrate the flange member 32 along an outer edge of the semicircular shaped portion thereof.

In addition, a lower surface of the flange member 32 includes a bottom flat surface 34 as a flat abutting section that forms a substrate rectangle. Concave grooves 35 are formed on the bottom flat surface 34. In the present embodiment, the concave grooves 35 are formed in two locations, each concave groove 35 respectively extends along a short direction of the bottom flat surface 34, and is disposed mutually spaced apart in the longitudinal direction of the bottom flat surface 34.

The shaft member 31 is provided with a substantially circular plate shaped rotation section 36, a cylindrical shaft section 37 that is installed in a protruding manner in a central section of a side surface of a first side of the rotation section 36, and fit together with a central hole H (refer to FIG. 4A) of rolled paper RP, and a circular shaft port 38 that is formed in a central section of a side surface of a second side of the rotation section 36 (a surface of a side that is opposite to a shaft section 37 side). Further, a plurality of engagement pieces 39 are formed on an inner peripheral surface of the shaft port 38 at regular intervals in a peripheral direction.

The outer diameter of the rotation section 36 is set to be slightly larger than the outer diameter of a maximum diameter of rolled paper RP. While a half of the shaft section 37 side rotation section 36 is inserted inside the support hole 33 of the flange member 32 in a rotatable manner, a half of a side that is opposite to the shaft section 37 is exposed. Ribs 40 that function as anti-slip measures when a user rotates the shaft member 31 by hand, are multiply formed in the rotation section 36 on a peripheral surface of a portion that is exposed from the support hole 33 at regular intervals in a peripheral direction.

In addition, in the medium holder 30, the movement restriction section 80 is configured so as to be attachable to both of either first sides or second sides of both end sections of rolled paper RP. The movement restriction section 80 is provided on a surface, a side surface of the flange member 32, which faces the restriction member 70 that is disposed on the back side plate 27 when the medium holder 30 is loaded into the medium loading section 28. Additionally, in the present embodiment, the movement restriction section 80 is also provided on a surface of a side that is opposite to the surface that faces the restriction member 70 of the flange member 32. In this manner, by providing the movement restriction section 80 on both side surfaces of the flange member 32, directionality of the medium holder 30 when holding an end section of rolled paper RP is removed, and therefore, it is possible to make the medium holder 30 easier to be handled. Additionally, the movement restriction section 80 may be disposed on one surface side of the flange member 32 only.

The movement restriction section 80 corresponds to the ratchet mechanism (refer to FIGS. 3A and 3B) of the restriction member 70, and the movement restriction section 80 of the present embodiment is provided with a hook section 81 that engages with the ratchet mechanism of the restriction member 70. Additionally, a concave section 90 (a revolution restriction section 90) is formed on a side surface section of the flange member 32 of the medium holder 30, and the hook section 81 is disposed inside the concave section 90. The concave section 90 is configured by a first concave section side surface 91*a*, a second concave section side surface 91*b*, and a concave section bottom surface 91*c*, and the hook section 81 is disposed on the concave section bottom surface 91*c*. Since the depth of the revolution restriction section 90 with respect to the side surface of the flange member 32 is longer than the height of the hook section 81 from the concave section bottom surface 91*c*, the hook section 81 does not project from the side surface of the flange member 32, and therefore, it is difficult to damage the hook section 81.

As shown in FIG. 7, a leading end of the hook section 81 of the movement restriction section 80 is pointed. Further, the hook section 81 is formed so as to be inclined in one direction. The reason for this is so that the hook section 81 can engage with the acute section 71 of the restriction member 70, which the ratchet mechanism is included, and restrict movement of the medium holder 30. The hook section 81 of the present embodiment is configured by a first hook section surface 81*a* and a second hook section surface 81*b* that are in contact with a tip section 81*t*. Further, the hook section 81 is configured so that, when the hook section 81 is viewed in plan view as a triangle that is configured by a virtual bottom side (surface) 81*c*, which faces the tip section 81*t* of the hook section 81, the first hook section surface 81*a* and the second hook section surface 81*b*, a fourth angle θ4 that is defined by the virtual bottom surface 81*c* and the first hook section surface 81*a* is an acute angle, a fifth angle θ5 that is defined by the virtual bottom surface 81*c* and the second hook section surface 81*b* is set to be greater than or equal to 90°, and a sixth angle θ6 that is defined by the first hook section surface 81*a* and the second hook section surface 81*b* is an acute angle. As a result of this, the hook section 81 is arranged so as to be inclined in one direction.

Figure 8:
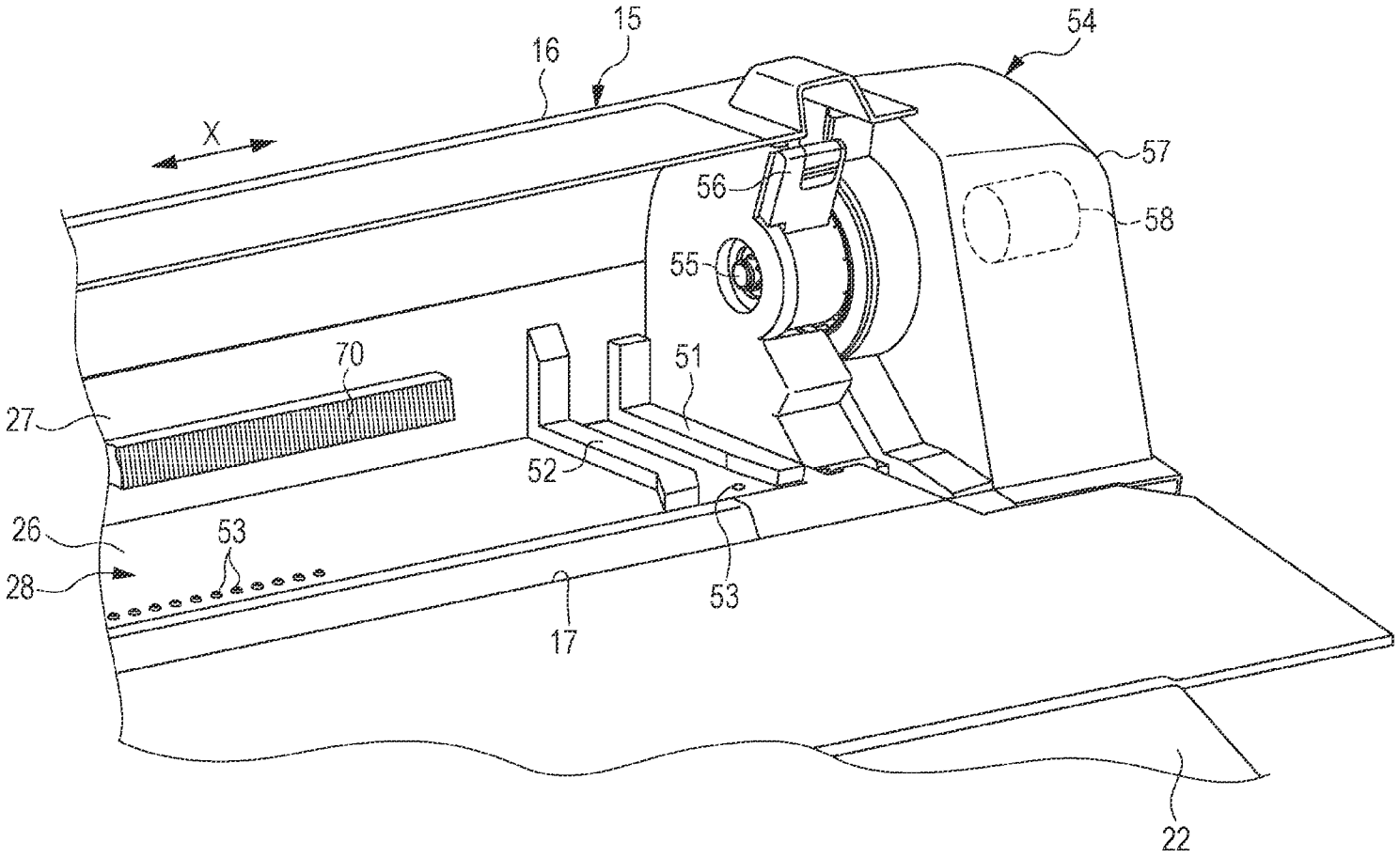
FIG. 8 is an outline view that shows a configuration of a rotational force application unit and a peripheral section thereof.
Figure 9:
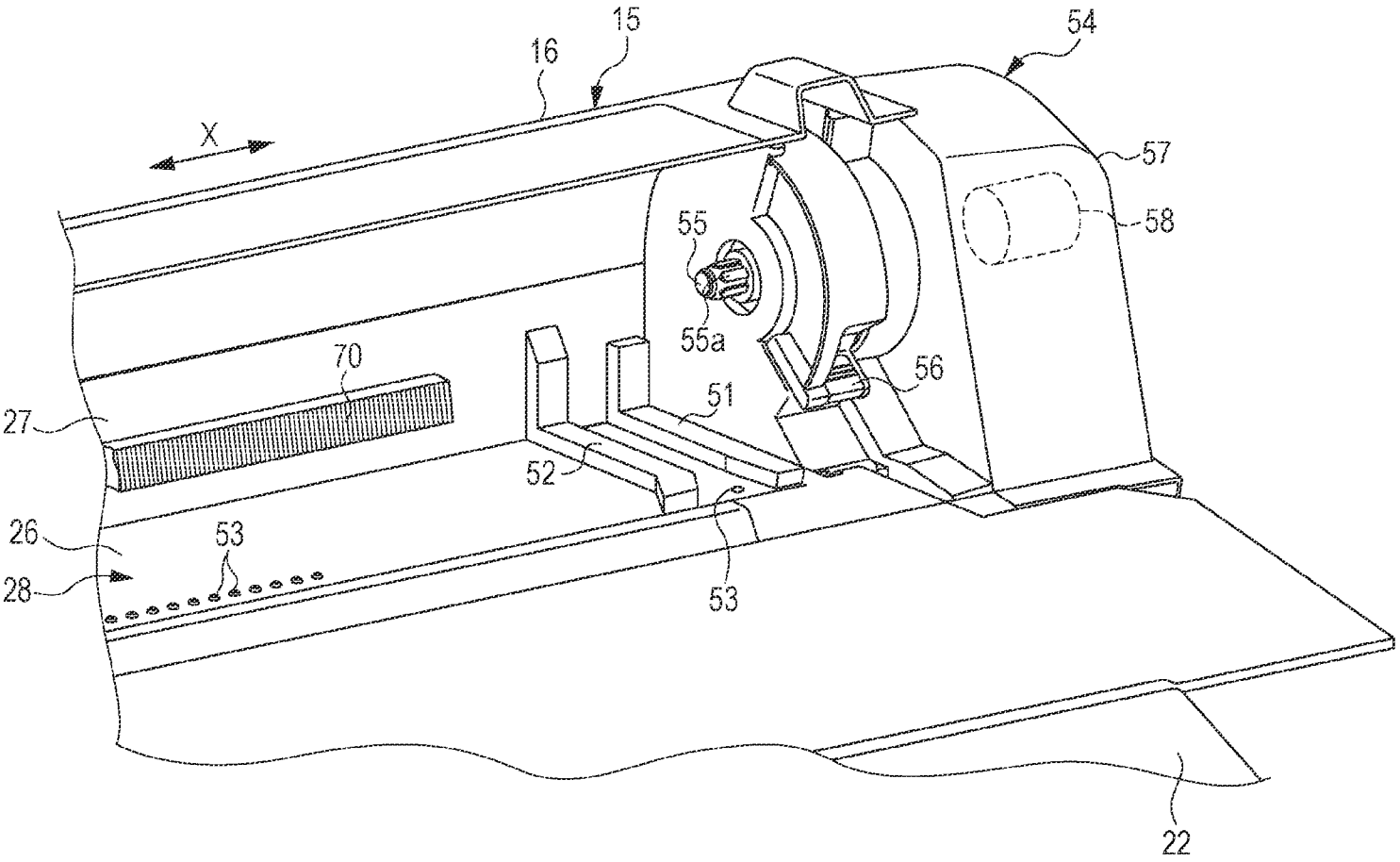
FIG. 9 is an outline view that shows a configuration of a rotational force application unit and a peripheral section thereof.

Next, configurations of the rotational force application unit that is provided on the first end side in the X axis direction of the paper supply section 15, and a peripheral section thereof will be described. FIGS. 8 and 9 are outline views that show a configuration of the rotational force application unit and the peripheral section thereof.

As shown in FIG. 8, a first guide member 51, which extends in a direction that intersects the X axis direction (a front-back direction in FIG. 8) is provided on the bottom plate 26 of the paper supply section 15 in one end section in the X axis direction (a right end section in FIG. 8). In addition, the first guide member 51 extends bending upward along the back side plate 27.

In addition, a second guide member 52, which extends in parallel to the first guide member 51 is provided on the bottom plate 26. The second guide member 52 extends bending upward along the back side plate 27 in the same manner as the first guide member 51. In this instance, an interval between the first guide member 51 and the second guide member 52 is set so as to be a dimension that is slightly larger than the length (thickness) dimension of the flange member 32 in the roll width direction (the attachment direction of the medium holder 30) when the medium holder 30 is attached to rolled paper RP. Accordingly, when rolled paper RP, to which the medium holder 30 is attached, is loaded into the medium loading section 28, the flange member 32 of the medium holder 30 is capable of being inserted between the first guide member 51 and the second guide member 52. Additionally, an end section on the paper supply opening 17 side of the second guide member 52 is bent at an angle of approximately 30° on a side that is opposite to a first guide member 51 side in order to make insertion of the flange member 32 into the medium loading section 28 easy.

In addition, a single projection 53 is provided on the bottom plate 26 in an end section of the paper supply opening 17 side between the first guide member 51 and the second guide member 52. Furthermore, a plurality of projections 53 are provided at regular intervals (refer to FIG. 2) on the bottom plate 26 in an end section of the paper supply opening 17 side in positions from a position that is separated from the second guide member 52 by a predetermined distance (a distance that corresponds to a width of approximately 10 inches of a minimum width of rolled paper RP) on a side that is opposite to the first guide member 51 side up to an end section on the bottom plate 26 on a side that is opposite to the first guide member 51 side (refer to FIG. 2).

Each projection 53 is set so that the heights thereof are respectively slightly lower than the depths of each concave groove 35 of the flange member 32, and the external diameters thereof are respectively slightly smaller than the widths of each concave groove 35 of the flange member 32. Accordingly, each projection 53 loosely fits together with each concave groove 35.

In the paper supply section 15, in a case in which rolled paper RP, to which the medium holder 30 is attached is loaded in the medium loading section 28, the rotational force application unit 54, which applies a rotational force to the rolled paper RP through the shaft member 31 is provided in a position that faces the second guide member 52 with the first guide member 51 interposed therebetween (in the right end section of the paper supply section 15 in FIG. 8).

The rotational force application unit 54 is provided with a rotational axis 55 that is configured to be moveable in the scanning direction X in a freely retractable manner with respect to the medium loading section 28, an operation lever 56 for operating the rotational axis 55 in order to retract the rotational axis 55 with respect to the medium loading section 28, and a motor 58 for rotationally driving the rotational axis 55, which is disposed inside a motor case 57.

Further, if the operation lever 56 is raised, the rotational axis 55 is moved along the scanning direction X to a refuge position (a position that is shown in FIG. 8) in which the rotational axis 55 takes refuge from the medium loading section 28 side, and if the operation lever 56 is lowered, the rotational axis 55 is moved along the scanning direction X to a protrusion position (a position that is shown in FIG. 9) in which the rotational axis 55 protrudes onto the medium loading section 28 side.

Further, as shown in FIG. 9, a plurality of engagement ribs 55*a* are provided on a peripheral surface of the rotational axis 55 at regular intervals in a peripheral direction. The rotational axis 55 enters a state of being inserted into the shaft port 38 (refer to FIG. 6) of the shaft member 31 as a result of moving to the protrusion position in a case in which rolled paper RP, to which the medium holder 30 is attached, is loaded in the medium loading section 28. If the rotational axis 55 is rotationally driven in this state, each rib 55*a* and each engagement piece 39 engage with one another in a rotational direction, and a rotational force is transmitted from the rotational axis 55 to the shaft member 31.

Figure 10:
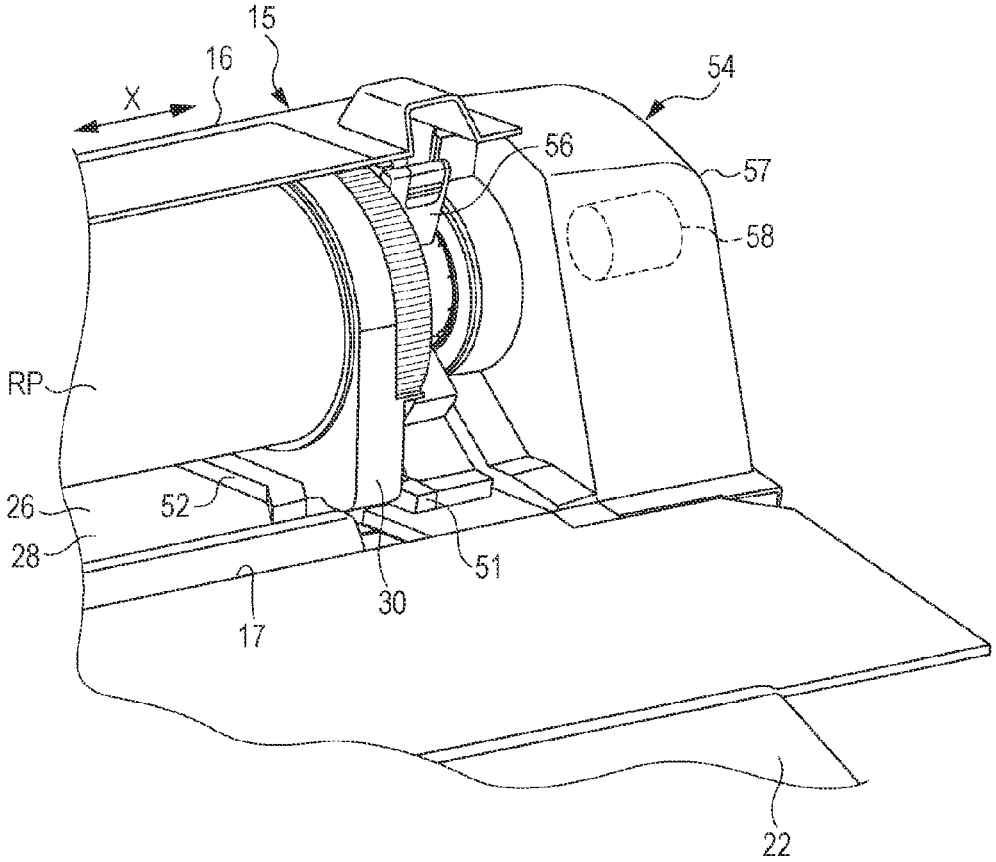
FIG. 10 is an explanatory diagram that shows an attachment method for attaching the medium holder to a medium loading device.
Figure 11:
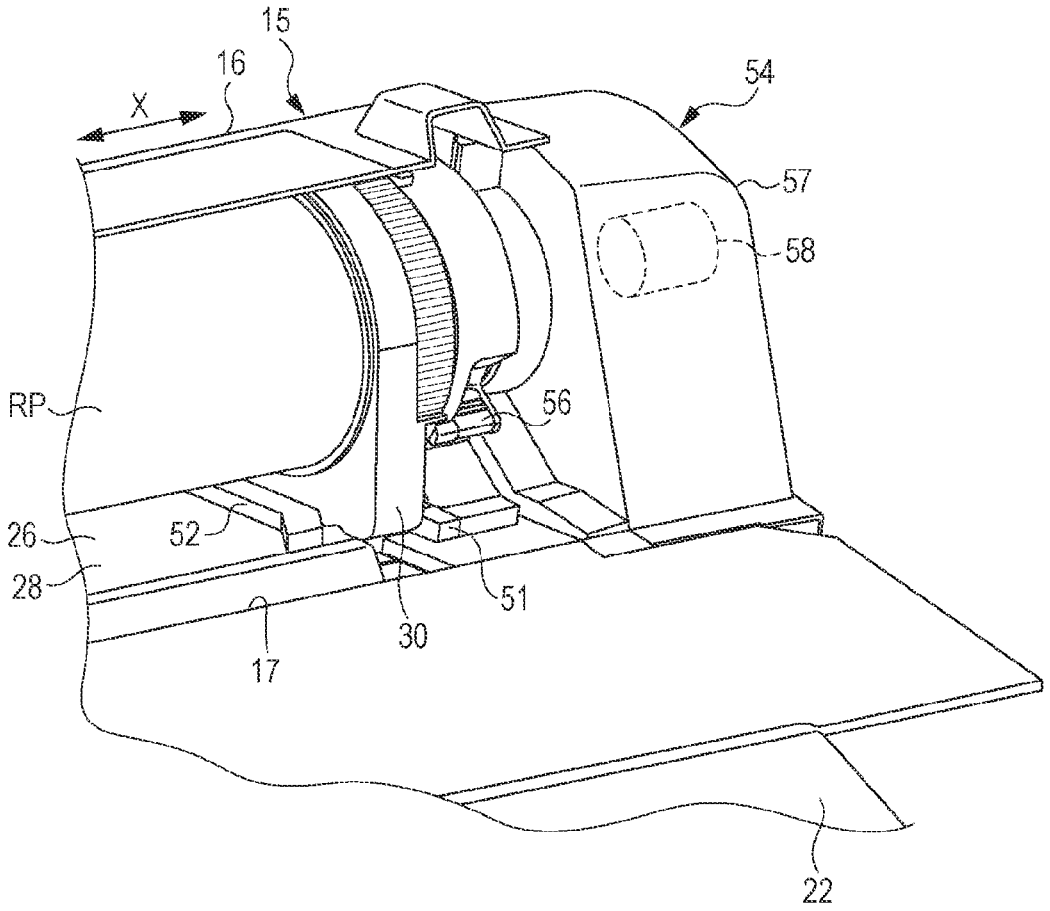
FIG. 11 is an explanatory diagram that shows an attachment method for attaching the medium holder to the medium loading device.

Next, an action method of the recording apparatus will be described. Firstly, an attachment method for attaching the medium holder to the medium loading device will be described. FIGS. 10 and 11 are explanatory diagrams that show an attachment method for attaching the medium holder to a medium loading device.

Firstly, in a case in which printing is performed on rolled paper RP, a user respectively fits the shaft section 37 of the shaft member 31 of the medium holder 30 together with the central holes H (refer to FIG. 4A) from both sides of the rolled paper RP. As a result of this, the medium holders 30 are respectively attached to both end sections of the rolled paper RP.

Subsequently, a user opens the opening and closing cover 16, and presses the rolled paper RP, to which the medium holders 30 are attached to both sides, that is, each medium holder 30 that supports the rolled paper RP, toward the medium loading section 28 while propping the rolled paper RP up with a hand.

When this is done, among the pair of medium holders 30 that support both ends of the rolled paper RP, the medium holder 30 of a first side is guided between the first guide member 51 and the second guide member 52 in the medium loading section 28. Further, when a front end section in a movement direction of each medium holder 30 approaches the medium loading section 28, each projection 53 loosely fits together with the concave grooves 35 of the front side in the movement direction of each flange member 32 after the flange member 32 of each medium holder 30 is respectively thrust over each projection 53.

At this time, since an impact is applied to each medium holder 30 by each projection 53, each projection 53 functions as an impact application section that applies an impact to each medium holder 30. Further, a user is made aware of the fact that each projection 53 has loosely fitted together with the concave grooves 35 of the front side in the movement direction of each flange member 32 as a result of feeling this impact with a hand.

Subsequently, when a user presses each medium holder 30 further toward the medium loading section 28 side, each projection 53 loosely fits together with the concave grooves 35 on a back side in the movement direction of each flange member 32 after the flange member 32 of each medium holder 30 is respectively thrust over each projection 53, and a surface of the front side in the movement direction of each flange member 32 abuts against the back side plate 27. That is, the rolled paper RP is loaded into the medium loading section 28 in a state of being supported by the medium holders 30.

Further, as shown in FIG. 10, the medium holder 30 of the first side is inserted between the first guide member 51 and the second guide member 52 in the medium loading section 28 while being guided by the first guide member 51 and the second guide member 52. Therefore, as a result of being held between the first guide member 51 and the second guide member 52, the medium holder 30 of the first side is substantially fixed in the scanning direction X. In addition, as a result of this, the rolled paper RP is positioned in the scanning direction X.

Furthermore, at this time, an impact is applied to each medium holder 30 by each projection 53. Further, a user is made aware of the fact that the rolled paper RP, to which each medium holder 30 is attached, is loaded into the medium loading section 28 as a result of feeling this impact with a hand.

In addition, in a state in which the rolled paper RP, to which the medium holders 30 are attached, is loaded into the medium loading section 28, the shaft port 38 of the shaft member 31 and the rotational axis 55 face one another in the scanning direction X in the medium holder 30 of the first side.

Further, if the operation lever 56 is lowered in this state as shown in FIG. 11, the rotational axis 55 is moved to a protrusion position, and inserted into the shaft port 38 of the shaft member 31 in the medium holder 30 of the first side.

Additionally, in the abovementioned manner, among the pair of medium holders 30 that hold both ends of the rolled paper, a position of the medium holder 30 of the first side is fixed as a result of the flange member 32 thereof being inserted between the first guide member 51 and the second guide member 52. Meanwhile, it is easy for the medium holder 30 of a second side to move in a direction that is opposite to a side on which the medium holder 30 of the second side holds the rolled paper RP and which applies a rotational force in accordance with a rotational action due to the transport of the rolled paper RP, and therefore, there is a concern that the medium holder 30 will come loose from the rolled paper RP. In such an instance, in the present embodiment, movement of the medium holder 30 is restricted by the restriction member 70 and the movement restriction section 80. This will be described in more detail below.

Figure 12A:
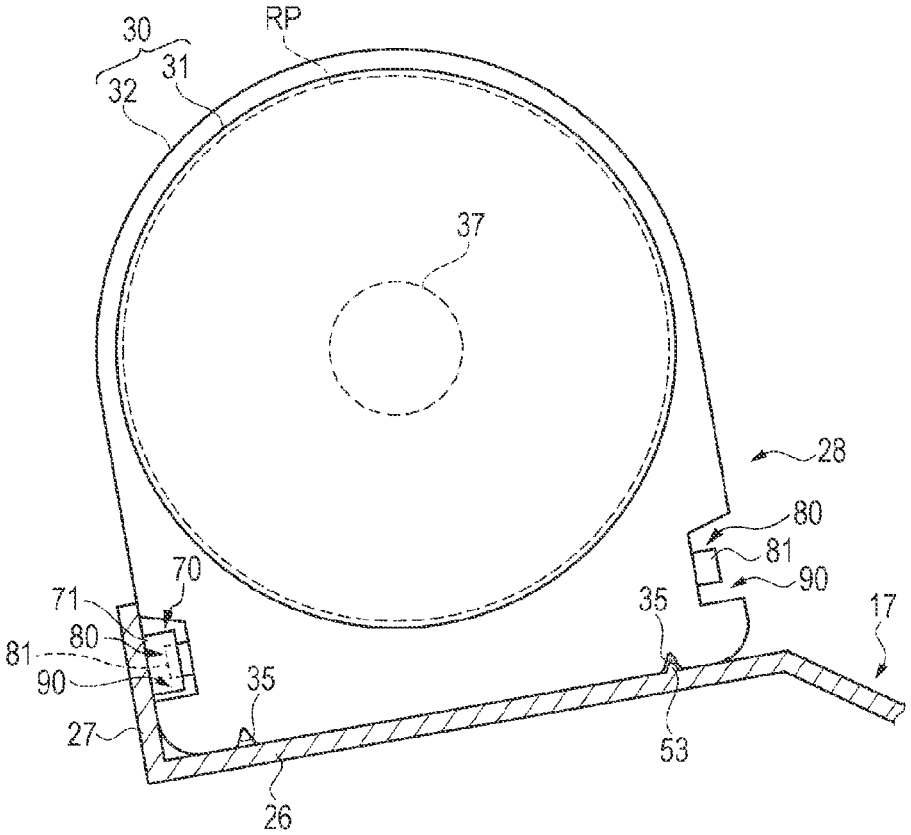
FIGS. 12A and 12B are schematic views that show a relationship between the movement restriction section and the restriction member.
Figure 12B:
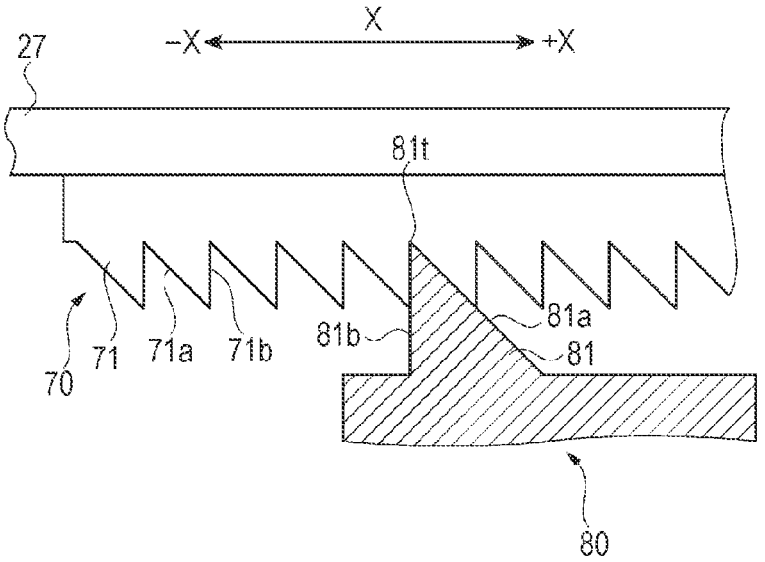

FIGS. 12A and 12B are schematic views that show a relationship between the movement restriction section and the restriction member, FIG. 12A is a lateral cross-sectional view that shows a loading state of the medium holder of the second side inside a medium loading section, and FIG. 12B is a plan cross-sectional view in which an engagement state of the movement restriction section and the restriction member is enlarged.

As shown in FIG. 12A, in the same manner as the medium holder 30 of the first side mentioned above, the medium holder 30 of the second side is loaded into the medium loading section 28 at the same time as the medium holder 30 of the second side. More specifically, a user presses the medium holder 30 toward the medium loading section 28 side. As a result of this, the projections 53 loosely fit together with the concave grooves 35 on the back side in the movement direction of the flange member 32, and a surface of a front side in the movement direction of the flange member 32 abuts against the back side plate 27. At this time, the movement restriction section 80 of the medium holder 30 of the second side and the restriction member 70 that is provided on the back side plate 27 engage with one another.

More specifically, as shown in FIG. 12B, a concave section between the acute section 71 of the restriction member 70 that configures the ratchet mechanism and the hook section 81 of the movement restriction section 80 engage with one another. To explain in further detail, the restriction member 70 and the hook section 81 of the movement restriction section 80 engage with one another so that a first surface 71*a* of a first acute section 71 of the restriction member 70 and the first hook section surface 81*a* of the hook section 81 come into contact with one another, and a second surface 71*b* of a second acute section 71 that is in contact with the first acute section 71 of the restriction member 70 and the second hook section surface 81*b* of the hook section 81 come into contact with one another. As a result of this, since the first surface 71*a* and the first hook section surface 81*a* are in contact with one another at gentle surfaces, movement in a +X direction with respect to the restriction member 70 is possible. That is, movement with respect to the medium holder 30 of the first side is possible in a direction in which the medium holder 30 of the second side holds the rolled paper RP, or in other words, in a direction in which the medium holder 30 of the second side approaches the medium holder 30 of the first side. Meanwhile, since the second surface 71*b* and the second hook section surface 81*b* are in contact with one another at steep surfaces (surfaces that are formed from substantially 90° in the present embodiment), it is difficult for the hook section 81 to move in a −X direction with respect to the restriction member 70. That is, movement with respect to the medium holder 30 of the first side in a direction that is opposite to a direction in which the medium holder 30 of the second side holds the rolled paper RP is restricted. In other words, movement with respect to the medium holder 30 of the first side in a direction in which the medium holder 30 of the second side recedes, is restricted.

In addition, in the recording apparatus 1 according to the present embodiment, in the abovementioned manner, in addition to a handling that restricts movement of the medium holder 30 in the X axis direction, a handling with respect to defects due to revolution of the medium holder 30 in a rotational direction of rolled paper RP is formed. More specifically, after the medium holder 30 is loaded into the medium loading section 28 in a state of holding the rolled paper RP, it is necessary for a user to pull sheets of paper P out from the rolled paper RP while unwinding in a paper supply opening 17 direction, and insert the pulled out sheets of paper P inside the main body 14 along the transport pathway thereof from the paper supply opening 17, but there is a concern that the medium holder 30 will revolves (moves) in the direction of the paper supply opening 17 due to a pull-out momentum when the sheets of paper P are pulled out in the paper supply opening 17 direction from the rolled paper RP, and that the rolled paper RP that is loaded in the medium loading section 28 will project out at this time. In such an instance, in the present embodiment, revolution of the medium holder 30 is restricted by the restriction member 70 and the revolution restriction section 90. That is, the recording apparatus 1 according to the present embodiment is provided with a medium loading section that includes a restriction member, which engages with a revolution restriction section that a medium holder is provided with, when the medium holder is mounted, a transport section that transports a rolled medium that is loaded in the medium loading section, and a recording section that performs recording on the rolled medium that is transported. Hereinafter, this will be described in more detail. Additionally, in the present embodiment, among the medium holders 30 that hold both ends section of the rolled paper RP, since the shaft port 38 of the shaft member 31 in the medium holder 30 of the first side is engaged with the rotational axis 55, which is disposed on a recording apparatus 1 side, revolution of the medium holder 30 of the first side is difficult. Therefore, in the present embodiment, a handling that prevents revolution of the medium holder 30 of the second side will be described. In addition, since configurations other than a revolution restriction section and a restriction member are the same as those of the recording apparatus 1 mentioned above, description thereof will be omitted.

Figure 13A:
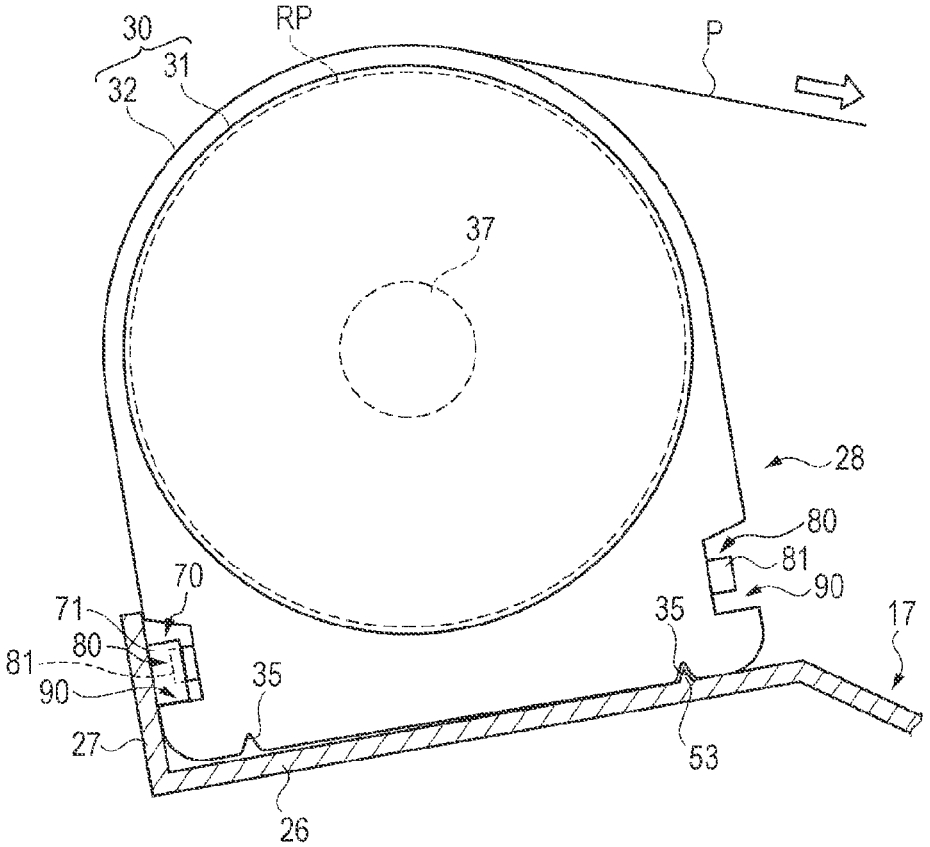
FIGS. 13A and 13B are schematic views that show a relationship between a revolution restriction section and the restriction member.
Figure 13B:
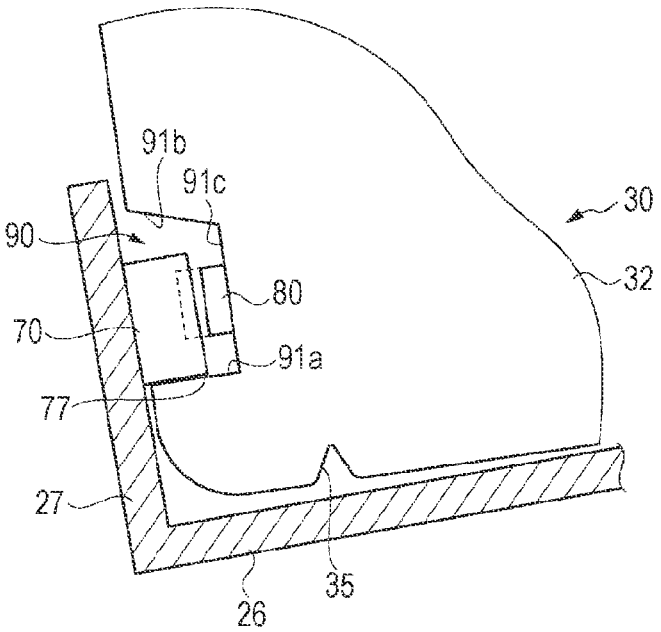

FIGS. 13A and 13B are schematic views that show a relationship between a revolution restriction section and a restriction member, FIG. 13A is a lateral cross-sectional view that shows a pulled-out state of rolled paper (sheets of paper) in a medium holder that is loaded in a medium loading section, and FIG. 13B is a plan cross-sectional view in which an engagement state of the movement restriction section and the restriction member is enlarged.

As shown in FIGS. 13A and 13B, the medium holder 30 is provided with a revolution restriction section 90 that restricts revolution of rolled paper RP in a pull-out direction when the medium holder 30 is installed in the medium loading section 28. In addition, in the medium holder 30, the revolution restriction section 90 is configured so as to be attachable to both of either first sides or second sides of both end sections of rolled paper RP. Further, the revolution restriction section 90 is a concave section, and the concave section of the revolution restriction section 90 is configured by the first concave section side surface 91*a*, the second concave section side surface 91*b*, and the concave section bottom surface 91*c*.

In addition, the restriction member 70 is disposed in the medium loading section 28. The restriction member 70 engages with the revolution restriction section that the medium holder 30 is provided with when the medium holder 30 is mounted in the medium loading section 28. The restriction member 70 according to the present embodiment is disposed on the back side plate 27 surface. Further, the restriction member 70 according to the present embodiment configures a convex section. Further, a flat surface 77 which faces to a bottom plate 26 surface in plan view is provided in the restriction member 70. Additionally, the flat surface 77 of the restriction member 70 and the first concave section side surface 91*a* of the revolution restriction section 90 in the medium holder 30, which is loaded in the medium loading section 28, are configured to face one another. In addition, the restriction member 70 is provided so as to run along an axial direction of rolled paper RP in a state in which rolled paper RP is loaded in the medium loading section 28. The restriction member 70 of the present embodiment is disposed in parallel to the X axis direction (refer to FIG. 2). As a result of this, a handling to various rolled papers RP with different width dimensions in the X axis direction is possible.

Further, in the abovementioned manner, a user loads the medium holder 30 into the medium loading section 28 by pressing the medium holder 30 toward the medium loading section 28 side. As a result of this, the projections 53 loosely fits together with the concave grooves 35 on the back side in the movement direction of the flange members 32, and the surface of the front side in the movement direction of the flange members 32 abuts against the back side plate 27 (refer to FIG. 12A).

Further, as shown in FIG. 13A, a user pulls sheets of paper P out from the rolled paper RP while unwinding in a paper supply opening 17 direction (an arrow direction in FIGS. 13A and 13B). At this time, the medium holder 30 attempts to revolve in the pull-out direction of rolled paper RP, but at this time, the revolution restriction section 90 and the convex section of the restriction member 70 that is provided on the back side plate 27 engage with one another.

More specifically, as shown in FIG. 13B, the restriction member 70 (the convex section) and the concave section of the revolution restriction section 90 engage with one another. To explain in further detail, the first concave section side surface 91*a* of the revolution restriction section 90 (the concave section), which faces the flat surface 77, abuts against the flat surface 77 of the restriction member 70 (the convex section), and further revolution (movement) of the medium holder 30 is no longer possible. That is, revolution of the medium holder 30 in the pull-out direction of the rolled paper RP is restricted.

Further, a user pulls sheets of paper P out from the rolled paper RP while unwinding in a paper supply opening 17 direction, and inserts the pulled out sheets of paper P inside the main body 14 along the transport pathway thereof from the paper supply opening 17. Thereafter, if a user closes the opening and closing cover 16 and then initiates a printing action by operating the operation panel 21, the rotational axis 55 is rotationally driven by the motor 58, and a rotational force of the rotational axis 55 is transported to the rolled paper RP through the shaft member 31. When this happens, each shaft member 31 and the rolled paper RP rotate integrally in a direction in which the sheets of paper P are sent out from the rolled paper RP. Further, printing (recording) is performed as a result of ink being ejected from the recording head 20 in a period in which sheets of paper P that are sent out from the rolled paper RP are transported along the transport pathway inside the main body 14 by the transport section. Further, sheets of paper P on which printing (recording) has been performed are discharged from the discharge opening 18.

Figure 14:
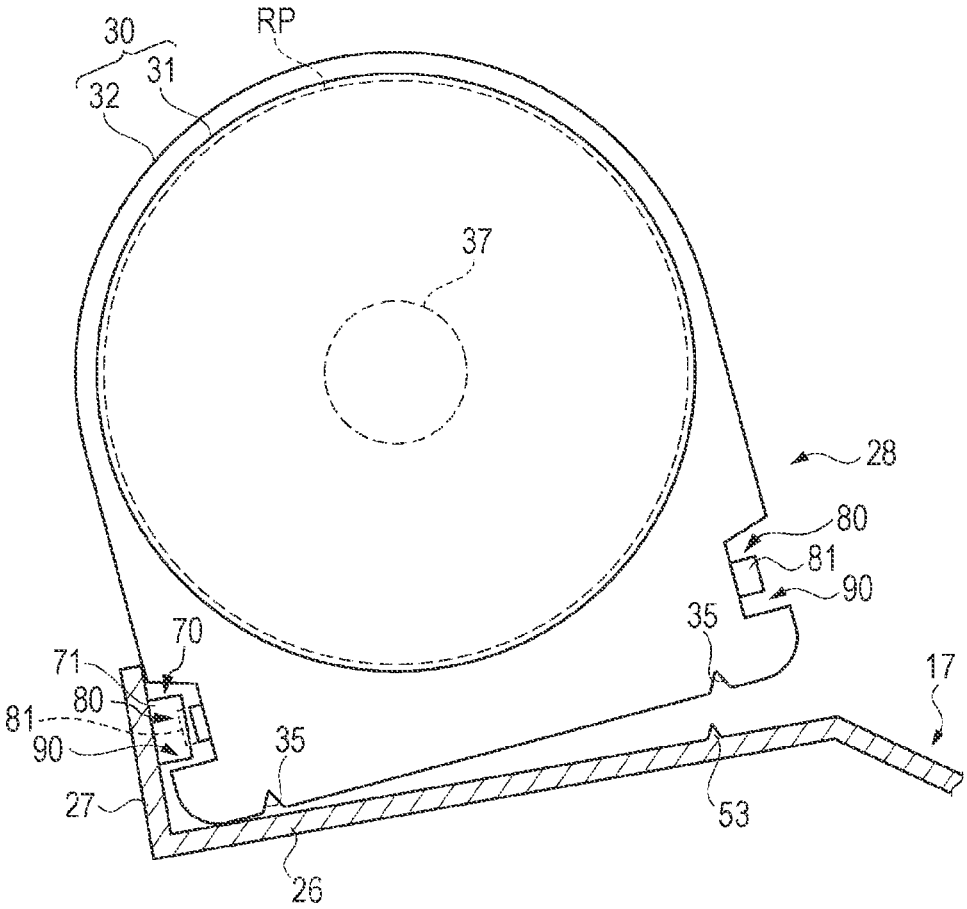
FIG. 14 is an explanatory diagram that shows a detachment method for detaching the medium holder from the medium loading device.

Next, a detachment method of a medium holder from a medium loading section will be described. FIG. 14 is an explanatory diagram that shows a detachment method for detaching the medium holder from the medium loading device. In a case in which the medium holder 30 that is loaded in the medium loading section 28 is detached from the medium loading section 28, as shown in FIG. 14, the medium holder 30 is lifted up so that the concave grooves 35, which loosely fit together with the projections 53 provided on the bottom plate 26 of the paper supply section 15, are separated from the projections 53. Thereafter, a user pulls the medium holder 30 out to the paper supply opening 17 side. As a result of this, it is possible to easily detach the medium holder 30 from the medium loading section 28 (the paper supply section 15). Additionally, in order to make it easy to lift up the concave groove 35 side of the medium holder 30, which loosely fit together with the projections 53, a configuration in which there is a gap between the restriction member 70 and the second concave section side surface 91*b* in a state in which the restriction member 70 and the revolution restriction section 90 are engaged is preferable. The gap between the restriction member 70 and the second concave section side surface 91*b* is opened in a manner in which an excessive load is not applied to the restriction member 70 and the individual lead electrode 91 when the medium holder 30 is lifted up in a manner in which the concave grooves 35, which loosely fit together with the projections 53, become sufficiently separated from the projections 53. In addition, the second concave section side surface 91*b* may be formed inclined in consideration of an inclination amount of the medium holder 30 when the medium holder 30 is lifted up.

According to the abovementioned embodiment, it is possible to obtain the following effects.

(1) When the medium holders 30, which hold both end sections of rolled paper RP, are loaded into the medium loading section 28, among the medium holders 30 that hold both ends of rolled paper RP, it is possible to fix the medium holder 30 of the first side by inserting the flange member 32 of the medium holder 30 of the first side between the first guide member 51 and the second guide member 52. In addition, movement of the medium holder 30 of the second side in a direction that is opposite to a side on which the medium holder 30 holds rolled paper RP is restricted as a result of the restriction member 70 that forms a ratchet mechanism and the movement restriction section 80 (the hook section 81) engaging with one another. As a result of this, since it is difficult for a distance between the medium holders 30 that hold both end sections of rolled paper RP, to change, the medium holders 30 no longer become shifted from rolled paper RP, and therefore, it is possible to stably operate the recording apparatus 1. In addition, since it is easy for the medium holders 30 to come loose from rolled paper RP in the recording apparatus 1 that is representative of large format printers (LFPs) due to the weight of the rolled paper RP that is loaded being heavy and the rolled paper RP being easily curved, the present embodiment is particularly effective in large format printers.

(2) When sheets of paper P are pulled out from the rolled paper RP in the paper supply opening 17 direction in a state in which the medium holders 30 that hold both end sections of rolled paper RP are loaded in the medium loading section 28, among the medium holders 30 that hold both ends of rolled paper RP, in the medium holder 30 of the first side, since the shaft port 38 of the shaft member 31 and the rotational axis 55 that is disposed on the recording apparatus 1 side engage with one another, it is possible to prevent revolution of the medium holder 30 of the first side. In addition, in the medium holder 30 of the second side, it is possible to prevent revolution of the medium holder 30 of the second side in a pull-out direction of rolled paper RP as a result of the flat surface 77 of the restriction member 70 (the convex section) and the revolution restriction section 90 (the first concave section side surface 91*a*) engaging with one another. As a result of this, the medium holder 30 no longer revolves and becomes shifted from the medium loading section 28, and therefore, it is possible to stably operate the recording apparatus 1.

Additionally, the invention is not limited to the abovementioned embodiment, and it is possible to add various changes and improvements to the abovementioned embodiment. Modification examples will be described below.

Modification Example 1

Figure 15:
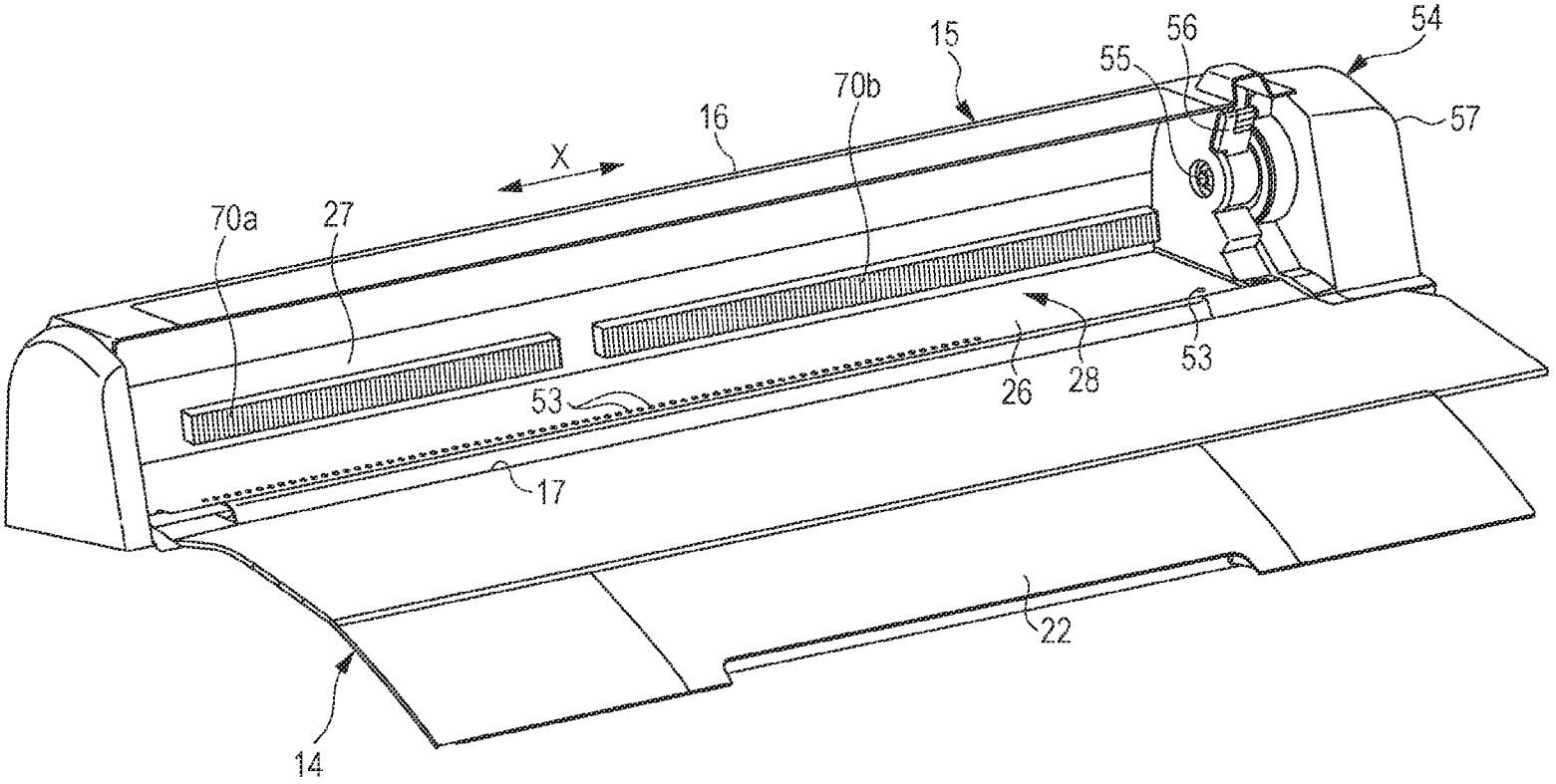
FIG. 15 is an outline view that shows a configuration of a restriction member according to modification example 1.
Figure 16:
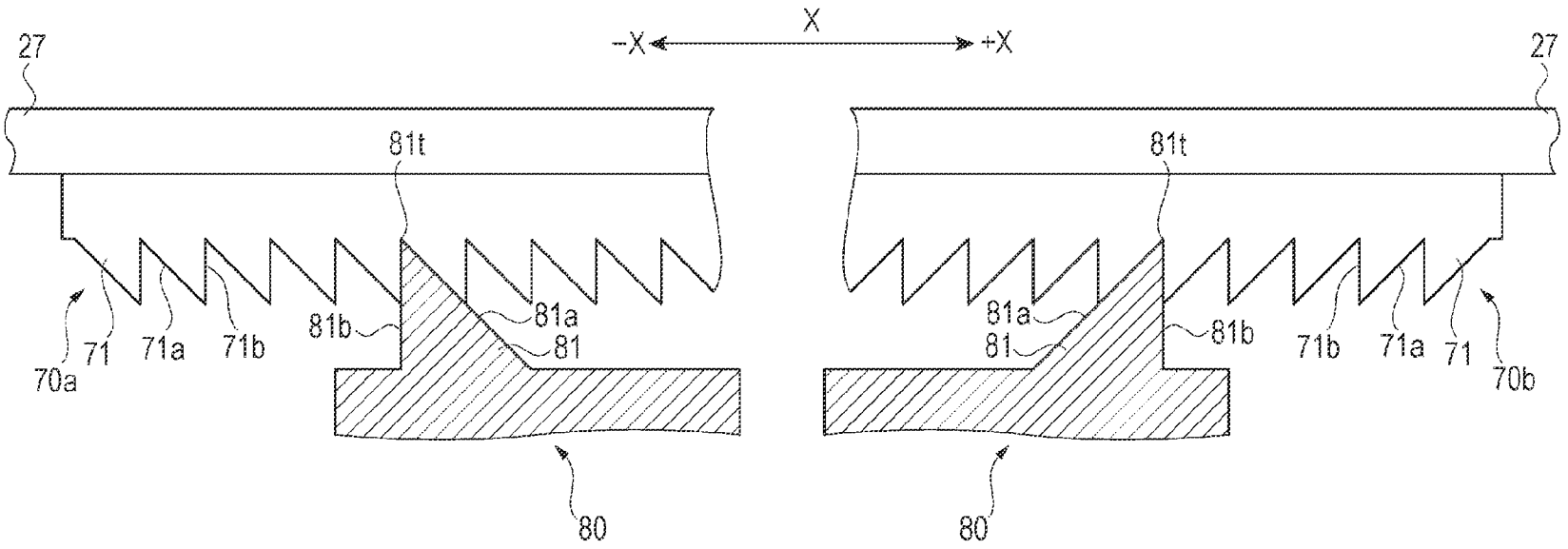
FIG. 16 is a schematic view that shows a relationship between a movement restriction section and the restriction member according to modification example 1.

In the abovementioned embodiment, the restriction member was disposed in a single location, but the invention is not limited to this configuration. For example, the restriction member may be provided in a plurality of locations. FIG. 15 is an outline view that shows a configuration of a restriction member according to modification example 1, and FIG. 16 is a schematic view that shows a relationship between a movement restriction section and the restriction member according to modification example 1.

As shown in FIG. 15, in the present modification example, restriction members 70*a* and 70*b* are disposed in two locations along the X axis direction in positions on the back side plate 27 of the paper supply section 15 that are substantially the same height from the bottom plate 26. Additionally, the paper supply section 15 according to the present modification example has a configuration in which the first guide member 51 and the second guide member 52 according to the abovementioned embodiment are omitted.

The configurations of the restriction members 70*a* and 70*b* are the same as the configuration (the ratchet mechanism) of the restriction member 70 according to the abovementioned embodiment, but inclination directions of the respectively acute sections 71 when the restriction members 70*a* and 70*b* are disposed, differ. More specifically, as shown in FIG. 16, the restriction member 70*a* is disposed in the same manner as the restriction member 70 according to the abovementioned embodiment, and the other restriction member 70*b* is disposed so that the inclination direction of the acute sections 71 of the restriction member 70*a* is an opposite direction thereto. That is, the restriction member 70*b* is disposed in a state in which the restriction member 70*a* is inverted by 180°.

Further, the medium holder 30 is pressed toward the medium loading section 28 in a state in which the medium holders 30 are attached to both end sections of rolled paper RP. At this time, each movement restriction section 80 of each medium holder 30 and each restriction member 70*a* and 70*b* that is provided on the back side plate 27 respectively engages. More specifically, as shown in FIG. 16, a concave section between the acute sections 71 of the restriction member 70*a* that configures a ratchet mechanism, and the hook section 81 of the movement restriction section 80 engage with one another. To explain in further detail, the restriction member 70*a* and the hook section 81 of the movement restriction section 80 engage with one another so that a first surface 71*a* of a first acute section 71 of the restriction member 70*a* and the first hook section surface 81*a* of the hook section 81 come into contact with one another, and a second surface 71*b* of a second acute section 71 that is in contact with the first acute section 71 of the restriction member 70*a* and the second hook section surface 81*b* of the hook section 81 come into contact with one another. As a result of this, since the first surface 71*a* and the first hook section surface 81*a* are in contact with one another at gentle surfaces, movement in a +X direction with respect to the restriction member 70*a* is possible. Meanwhile, since the second surface 71*b* and the second hook section surface 81*b* are in contact with one another at steep surfaces (surfaces that are formed from substantially 90° in the present embodiment), it is difficult for the hook section 81 to move in a −X direction with respect to the restriction member 70*a*.

In the same manner, a concave section between the acute sections 71 of the restriction member 70*b* that configures a ratchet mechanism, and the hook section 81 of the movement restriction section 80 engage with one another. To explain in further detail, the restriction member 70*b* and the hook section 81 of the movement restriction section 80 engage with one another so that a first surface 71*a* of a first acute section 71 of the restriction member 70*b* and the first hook section surface 81*a* of the hook section 81 come into contact with one another, and a second surface 71*b* of a second acute section 71 that is in contact with the first acute section 71 of the restriction member 70*b* and the second hook section surface 81*b* of the hook section 81 come into contact with one another. As a result of this, since the first surface 71*a* and the first hook section surface 81*a* are in contact with one another at gentle surfaces, movement in a +X direction with respect to the restriction member 70*b* is possible. Meanwhile, since the second surface 71*b* and the second hook section surface 81*b* are in contact with one another at steep surfaces (surfaces that are formed from substantially 90° in the present embodiment), it is difficult for the hook section 81 to move in a +X direction with respect to the restriction member 70*b*.

If such a configuration is used, the medium holders 30 that are attached to both end sections of rolled paper RP can move in directions that approach one another, and movement in a direction that is opposite to a direction in which the medium holders 30 holds rolled paper RP is restricted. As a result of this, shifting of the medium holders 30 from the rolled paper RP is prevented. In addition, this is suitable for a case in which a center in a roll width direction (the X axis direction) of rolled paper RP is set as an alignment of printing.

Modification Example 2

Figure 17:
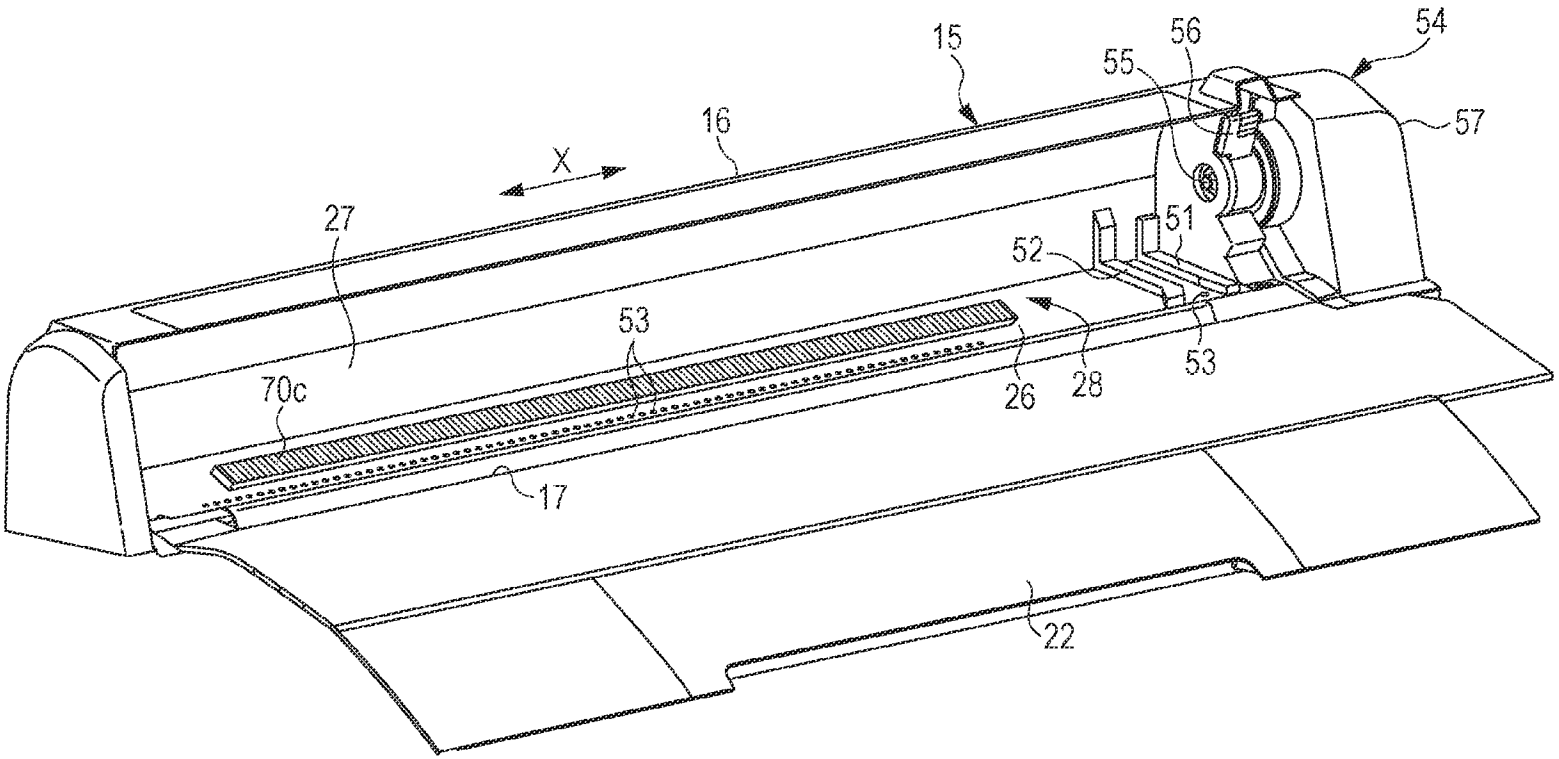
FIG. 17 is an outline view that shows a configuration of a restriction member according to modification example 2.
Figure 18:
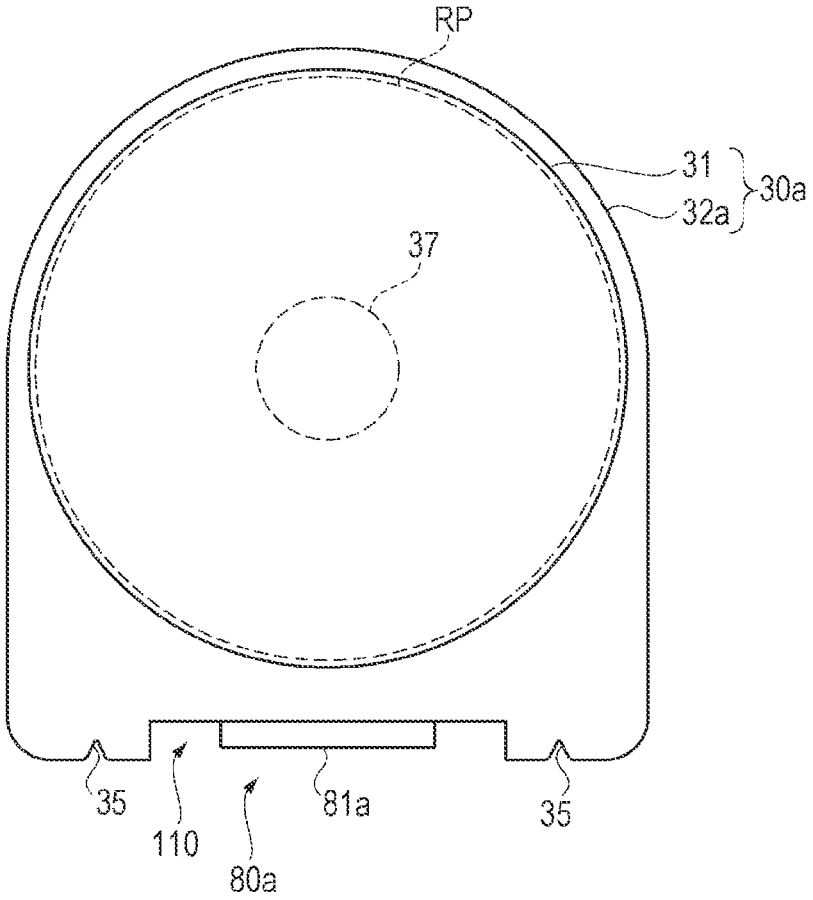
FIG. 18 is an outline view that shows a configuration of a medium holder according to modification example 2.

In the abovementioned embodiment, the restriction member was disposed on the back side plate 27, but the invention is not limited to this configuration. For example, the restriction member may be disposed in another site such as on the bottom plate 26. FIG. 17 is an outline view that shows a configuration of a restriction member according to modification example 2, FIG. 18 is an outline view that shows a configuration of a medium holder according to modification example 2, and FIG. 19 is a schematic view that shows a relationship between a movement restriction section and the restriction member according to modification example 2.

As shown in FIG. 17, a restriction member 70*c* is disposed on the bottom plate 26 of the paper supply section 15. More specifically, in the restriction member 70*c*, a plurality of acute sections 71, the leading ends of which are pointed, are arranged in parallel along the X axis direction. In addition, the acute sections 71 are arranged so as to be inclined in one direction. The restriction member 70*c* configures a ratchet mechanism, and the specific configuration thereof is the same as that of the restriction member 70 of the abovementioned embodiment.

In addition, a medium holder 30*a* has a configuration that is provided with a movement restriction section 80*a* (a hook section 81*a*) in a manner that engages with the restriction member 70*c*. More specifically, as shown in FIG. 18, the movement restriction section 80*a* is provided on a surface, which is a bottom surface of the flange member 32*a*, and which faces the restriction member 70*c*, which is disposed on the bottom plate 26 when the medium holder 30*a* is loaded into the medium loading section 28. The movement restriction section 80*a* corresponds to the ratchet mechanism of the restriction member 70*c*, and is provided with a hook section 81*a* that engages with the ratchet mechanism of the restriction member 70*c*. A concave section 110 is formed in a bottom surface section of the flange member 32*a* of the medium holder 30*a*, and the hook section 81*a* is disposed inside the concave section 110. The hook section 81*a* has a shape in which the leading ends thereof are pointed, and is formed so as to be inclined in one direction. Additionally, since the basic configuration of the hook section 81*a* is the same as that of the abovementioned embodiment, description thereof will be omitted.

Figure 19:
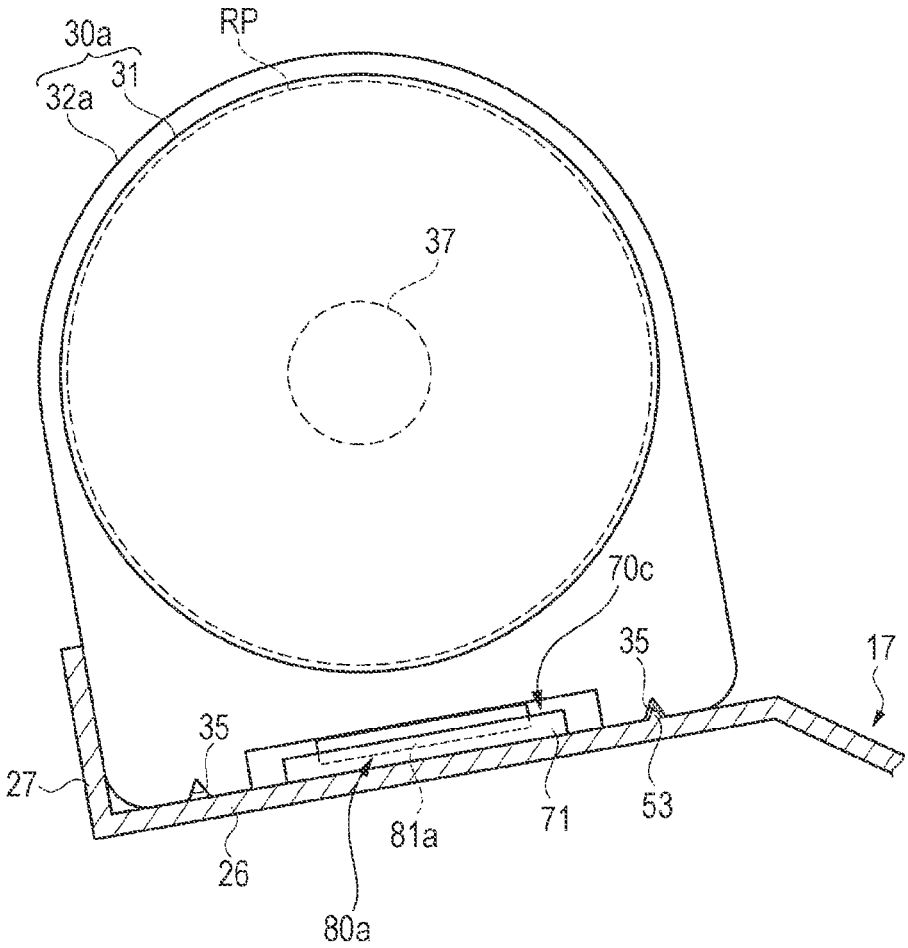
FIG. 19 is a schematic view that shows a relationship between a movement restriction section and the restriction member according to modification example 2.

Further, as shown in FIG. 19, the movement restriction section 80*a* of the medium holder 30*a* and the restriction member 70*c* engage with one another. More specifically, a concave section between the acute sections 71 of the restriction member 70*c* that configures a ratchet mechanism, and the hook section 81*a* of the movement restriction section 80*a* engage with one another. As a result of this, the medium holder 30*a* can move in a +X direction with respect to the restriction member 70*c*. That is, the medium holder 30*a* can move with respect to the medium holder 30*a* of the first side in a direction that the medium holder 30*a* of the second side holds rolled paper RP, or in other words, in a direction in which the medium holder 30 of the second side approaches the medium holder 30 of the first side. Meanwhile, it is difficult for the hook section 81*a* to move in a −X direction with respect to the restriction member 70*c*. That is, movement in a direction that is opposite to a direction in which the medium holder 30*a* of the second side holds rolled paper RP with respect to the medium holder 30*a* of the first side is restricted. In other words, movement in a direction in which the medium holder 30*a* of the second side becomes separated from the medium holder 30*a* of the first side is restricted. Furthermore, since movement of the medium holder 30*a* on a bottom surface side is restricted, revolution of the medium holder 30*a* in a rotational direction in plan view is also reduced. In addition, since the weight of the medium holder 30*a* itself and rolled paper RP are applied, it is easy to retain an engagement state of the movement restriction section 80*a* and the restriction member 70*c*, and therefore, movement is restricted and it is easy to hold a position. Additionally, the present modification example, other modification examples and the abovementioned embodiment may be combined as appropriate.

Modification Example 3

In the abovementioned embodiment, only one hook section 81 (81*a*) is provided in the movement restriction section 80 (80*a*) in the medium holder 30 (30*a*), but the invention is not limited to this. A plurality of hook sections 81 may be provided in the movement restriction section 80. If such a configuration is used, since a contact area due to engagement of the restriction member 70 (70*a*, 70*b*, 70*c*) and the hook section 81 (81*a*) is increased, it is possible to further improve a movement restriction ability.

Modification Example 4

In the abovementioned embodiment, rolled paper RP is described as an example of a rolled medium, but the invention is not limited to this. For example, plastic film, cloth, foil or the like may be used as a rolled medium. Even if configured in this manner, it is possible to obtain the same effects as the abovementioned embodiment.

Modification Example 5

In the abovementioned embodiment, in the recording head, a configuration in which ink is spouted is used, but the invention is not limited to this. For example, a configuration that performs recording by spouting a fluid other than ink (including liquid state materials that are formed by particles of a liquid or a functional material being dispersed, or mixed into a liquid, fluid state materials such as gels, and solids that can be fluidized and ejected as fluid), may be used. In addition, as the recording apparatus, for example, any liquid state ejecting apparatus that performs recording by ejecting a liquid state material that includes materials such as electrode materials and color materials (pixel materials), which are used in the manufacturing of liquid crystal displays, EL (electroluminescence) displays, surface-emitting displays and the like in a dispersed or dissolved form may be used. In addition, a fluid state material ejecting apparatus that ejects a fluid state material such as a gel (for example, a physical gel), may be used. Further, it is possible to adopt the invention in a fluid ejecting apparatus of any of these fluid ejecting apparatuses. Additionally, in the present specification, "fluid" refers to a concept that does not include a fluid that is formed from gas only and for example, includes liquids (inorganic solvents, organic solvents, liquid solutions, liquid resins, liquid metals (metallic melts)), liquid state materials, fluid state materials, and the like.

The entire disclosure of Japanese Patent Application No. 2014-224971, filed Nov. 5, 2014 is expressly incorporated by reference herein.

What is claimed is:

1. A medium loading device comprising:

a first medium holder;

a second medium holder that has a hook section; and a restriction member that engages with the hook section;

wherein the hook section is inclined in one direction so that the second medium holder is configured to move in a first direction toward the first medium holder and is restricted from moving in a second direction away from the first medium holder.

2. The medium loading device according to claim 1, further comprising:

a first guide member; and a second guide member;

wherein the first medium holder is inserted between the first guide member and the second guide member.

3. The medium loading device according to claim 2, wherein the second guide member is bent to a side that opposes the first guide member.

4. A recording apparatus comprising:

a medium loading device according to claim 1;

a transport section that transports a rolled medium that is loaded in the medium loading device; and a recording section that performs recording on the rolled medium that is transported.

* * * * *